United States Patent [19]

Ohno

[11] Patent Number: 5,057,876

[45] Date of Patent: Oct. 15, 1991

[54] IMAGE FORMING APPARATUS WITH AN IMAGE EDITING FUNCTION

[75] Inventor: Yasuhiro Ohno, Osaka, Japan

[73] Assignee: Minolta Camera Kabushiki Kaisha, Osaka, Japan

[21] Appl. No.: 488,227

[22] Filed: Mar. 5, 1990

[30] Foreign Application Priority Data

Mar. 6, 1989 [JP] Japan ..... 1-54685

[51] Int. Cl.[5] ..... G03G 15/01

[52] U.S. Cl. ..... 355/328; 355/24; 355/245

[58] Field of Search ..... 355/328, 326, 327, 245, 355/23-26

[56] References Cited

U.S. PATENT DOCUMENTS

| | | | |
|---|---|---|---|
| 3,914,043 | 10/1975 | McVeigh . | |
| 4,743,946 | 5/1988 | Nishimori et al. . | |
| 4,860,049 | 8/1989 | Toshimitsu et al. | 355/328 X |
| 4,862,216 | 8/1989 | Higashi et al. | 355/328 X |
| 4,884,096 | 11/1989 | Kusuda et al. | 355/328 X |
| 4,885,611 | 12/1989 | Higashio et al. | 355/328 X |
| 4,912,504 | 3/1990 | Ito et al. | 355/25 X |
| 4,937,266 | 6/1990 | Kohtani et al. | 355/326 X |

FOREIGN PATENT DOCUMENTS

| | | |
|---|---|---|
| 51-36951 | 3/1976 | Japan . |
| 61-203474 | 9/1986 | Japan . |
| 64-56459 | 3/1989 | Japan . |

*Primary Examiner*—R. L. Moses

*Attorney, Agent, or Firm*—Burns, Doane, Swecker & Mathis

[57] ABSTRACT

An image forming apparatus having an image editing function and a plurality of developing devices capable of developing different colors respectively, wherein, for example, where images are copied from two sheets of document or a double-side document on the both sides of a copying paper, or where the both pages of an opened book are copied in a split manner, the position on a copying paper of change-over of the developing device is set only for one sheet of document in double-size copy from the respective two sheets of document, only for one page of the opened book, and only for one side of the double-side document, and thereby the position of change-over is determined automatically for the other sheet of document, the other page or the rear side, and therefore the devices for setting the position of change-over of the developing device are reduced in number, and the operation is simplified.

32 Claims, 26 Drawing Sheets

IMAGE FORMING APPARATUS WITH AN IMAGE EDITING FUNCTION

BACKGROUND OF THE INVENTION

1. Field of the Invention

The present invention relates to an image forming apparatus such as a copying machine or printer, and to be detailed further, relates to an image forming apparatus capable of forming an image with a plurality of colors.

2. Description of Related Art

Simultaneous multicolor copying machines have been developed which can form an image wherein both sides of a boundary preliminarily selected in the direction of scanning an original document are colored differently by one copying operation. This is such that, for example, means for selecting the position for changing of the image color such as a sliding type editing lever is disposed on a document table, and a plurality of developing devices are changed-over selectively with this position of change-over set as a boundary, and thereby an image is formed with different colors by individual colors of the developing devices.

On the other hand, copying machines have been put in practical use which, in addition to such a copying function, have a function that when a original document of plural sheets one side of which is bound such as a book, is copied, it is placed on a document table with both pages opened, and a copy corresponding to each opened page is produced in a split manner one by one page, or a copy is produced on the both sides of one copying sheet.

Then, where change-over of the image color is performed in copying a book in the above-described copying machine, for example, for a book whereto indexes are affixed such as a reference book, it is requested that this index portion, that is, each portion of the right and left ends of the both opened pages is formed into an image of a different color. In such a case, when one editing lever is mounted, only position of change-over for one page can be selected, and in copying, the other page is formed into a monochromatic image. For this reason, it is considered that the position of change-over is selected again, and copying is performed twice, but this method cannot make the most of the copy editing function for books, being inefficient.

Then, it is considered that two editing levers are disposed and two positions of change-over are selected, but this method is expensive in cost in comparison with the method using one lever, and it is required that the position of change-over is selected for each page despite that the right and left pages are of the same form, and therefore this method is inefficient and the operation thereof is complicated like the former method.

Also, for example, where the book as described above is disjointed into sheets of double-side document, and the double-side document is copied on the both sides of one copying paper with the index portion color-identified like the above case, a desired copy cannot be obtained unless the position of the change-over of the rear surface is changed after completing the copy operation of the surface. Particularly, where an automatic document feeder is used, it is impossible to change the position of change-over before copying the rear surface, and the problem exists that for the rear surface, a portion other than the index portion is color-identified.

SUMMARY OF THE INVENTION

The present invention has been achieved in the light of circumstances as described above, and a principal objective thereof is to improve the operationability of an image forming apparatus which has a so-called editing function and can form an image with a plurality of colors.

A second objective of the present invention is to provide an image forming apparatus wherein, for example, when the both pages of an opened book are copied on one copy sheet, on two copy sheet, or on the both sides of one copy sheet respectively, the position of the change-over of the copy color is selected on one page, and thereby the position of the change-over on the other page is also set automatically as intended by the operator.

A third objective of the present invention is to provide an image forming apparatus wherein, for example, when two sheets of original document are copied on one copy sheet, on two copy sheet respectively, or on both sides of one copy sheet respectively, the position of the change-over of the copy color is selected on one page, and thereby the position of the change-over on the other page is also set automatically as intended by the operator.

A fourth objective of the present invention is to provide an image forming apparatus wherein, for example, when a double-side document is copied on one copy sheet, on two copy sheet, or on both sides of one copy sheet respectively, the position of the change-over of the copy color is selected on one page, and thereby the position of the change-over on the other page is set automatically as intended by the operator.

An image forming apparatus of the present invention comprises a plurality of developing devices, means for developing an image with changing-over the developing devices at arbitrary positions in the direction of the main scanning of an original image in one copying operation, means for selecting a position of the change-over of the developing device, storing means for storing the selected position, selecting means for selecting the position of the change-over among from the selected position, the position determined in relation to the position stored in the storing means and the position evaluated by calculation, and means for changing-over the developing device according to the result of a selection made by this selecting means.

Accordingly, by selected the position of the change-over of the developing device on one side of a double-side document, on one of two aligned sheets of original document or on one page of an opened book, the developing device, in other words, the developed color is changed-over automatically at the position intended by the operator also on the other side.

The above and further objects and features of the invention will more fully be apparent from the following detailed description with accompanying drawings.

DESCRIPTION OF THE PREFERRED EMBODIMENTS

Hereinafter, description is made on the present invention based on drawings showing an embodiment thereof.

Figure 1:
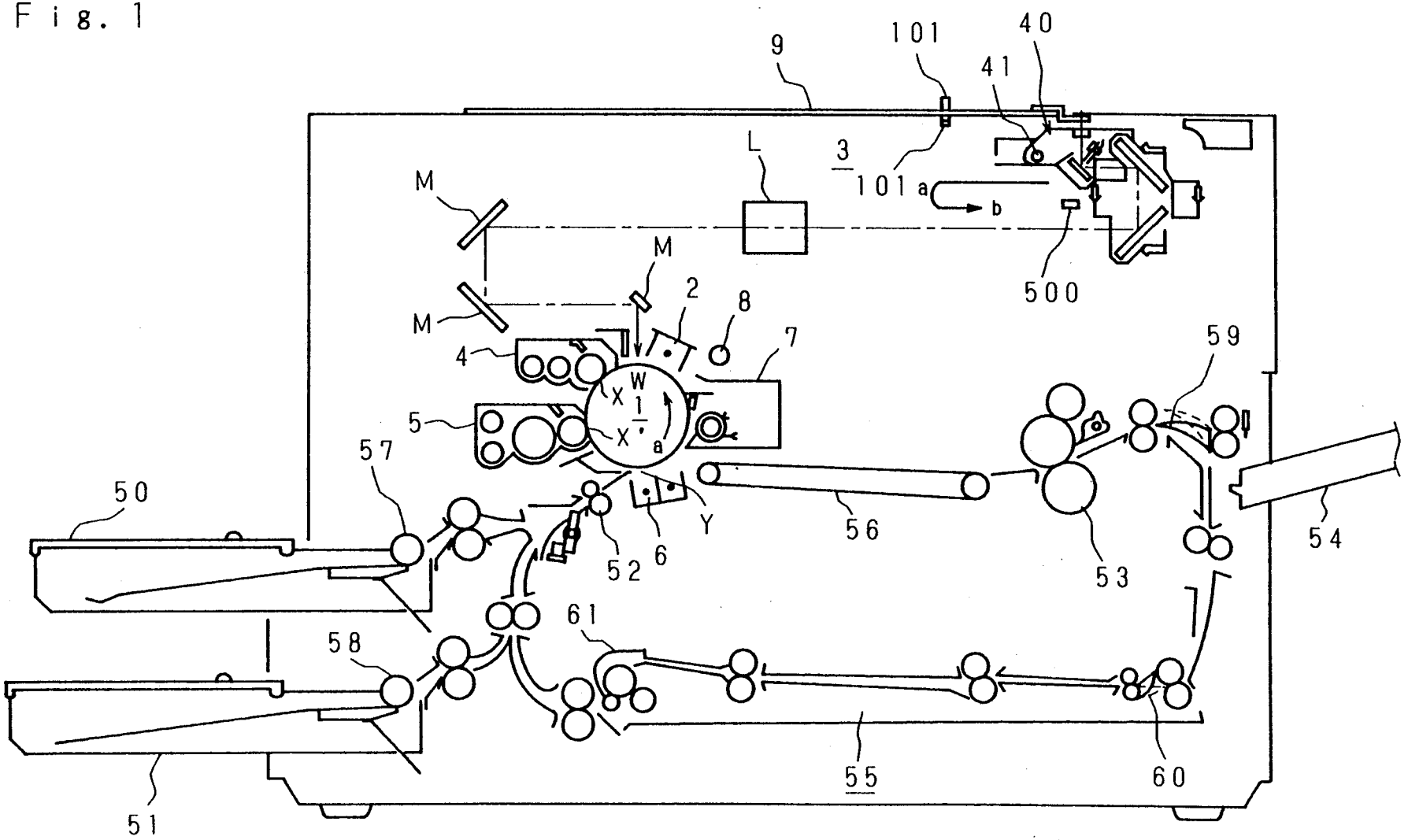
FIG. 1 is a side cross-sectional view showing an internal configuration of an image forming apparatus of the present invention.

FIG. 1 is a schematic side cross-sectional view showing an internal structure of a copying machine which is an example of an image forming apparatus in accordance with the present invention, and the configuration of the copying machine is described together with a basic copying operation thereof with referring to drawing.

First, in the state that a photosensitive drum 1 is rotated in the direction as shown by an arrow a, a constant quantity of charges are given to the surface of the photosensitive drum 1 by a discharge of a charger 2.

Subsequently, a scanner 40 having an exposure lamp 41 of an optical system 3 irradiates light onto an original document placed on a document glass plate 9 while performing scanning operation in the direction as shown by an arrow b. The reflected light exposes the surface of the photosensitive drum 1 at an exposure point W through mirrors M and a lens L, and thereby an electrostatic latent image corresponding to an original document image is formed on the photosensitive drum 1.

This electrostatic latent image is supplied with toner in the developing region X or X' which faces the following first developing device 4 or second developing device 5 to be made into a real image, and a toner image reproducing the original image is formed.

On the other hand, copy sheet is fed selectively from an upper cassette 50 or a lower cassette 51 by a paper feed roller 57 or 58, and is carried to a part facing a transfer charger 6 (a transferring region Y) while timing-matched with the toner image on the photosensitive drum 1 by a pair of timing rollers 52. Here, the above-mentioned toner is transferred to the copy sheet, and is thereafter carried to a position between a pair of fixing rollers 53 by a carrying belt 56, and the above-mentioned toner image is fuse-fixed to the copy sheet, and is discharged to a paper outlet part 54.

However, when a double-side copy mode or a composite copy mode is selected, a first change-over claw 59 is rotated clockwise in FIG. 1 (as shown by a broken line), and the copy sheet after image fixing is not discharged to the paper outlet part 54, but is carried downward. Here, in the case of the composite copy mode, the copy sheet is received intact in an intermediate tray 55. In the the double-side copy mode, a second change-over claw 60 is rotated clockwise in FIG. 1, and the copy sheet passes through a reversing part 61 to be turned over, thereafter being received in the intermediate tray 55. The copy sheet received once in the intermediate tray 55 is carried again to the transferring region Y, and a second transfer of the toner image is applied like the first transfer, and the image is fixed by the pair of fixing rollers 53, thereafter it is discharged.

On the surface of the photosensitive drum 1, the residual toner is scraped off by a cleaning device 7, and further the residual charges are erased by light irradiation of an eraser lamp 8, and the next development is prepared for.

As described above, the copying machine in this embodiment has two developing devices 4 and 5, and the respective developing devices have developers of colors differing from each other. Then, these developing devices are driven selectively by a controlling mechanism as described later, and thereby a development with a desired developed color among colors of developers stored in the respective developing devices can be performed.

Figure 2:
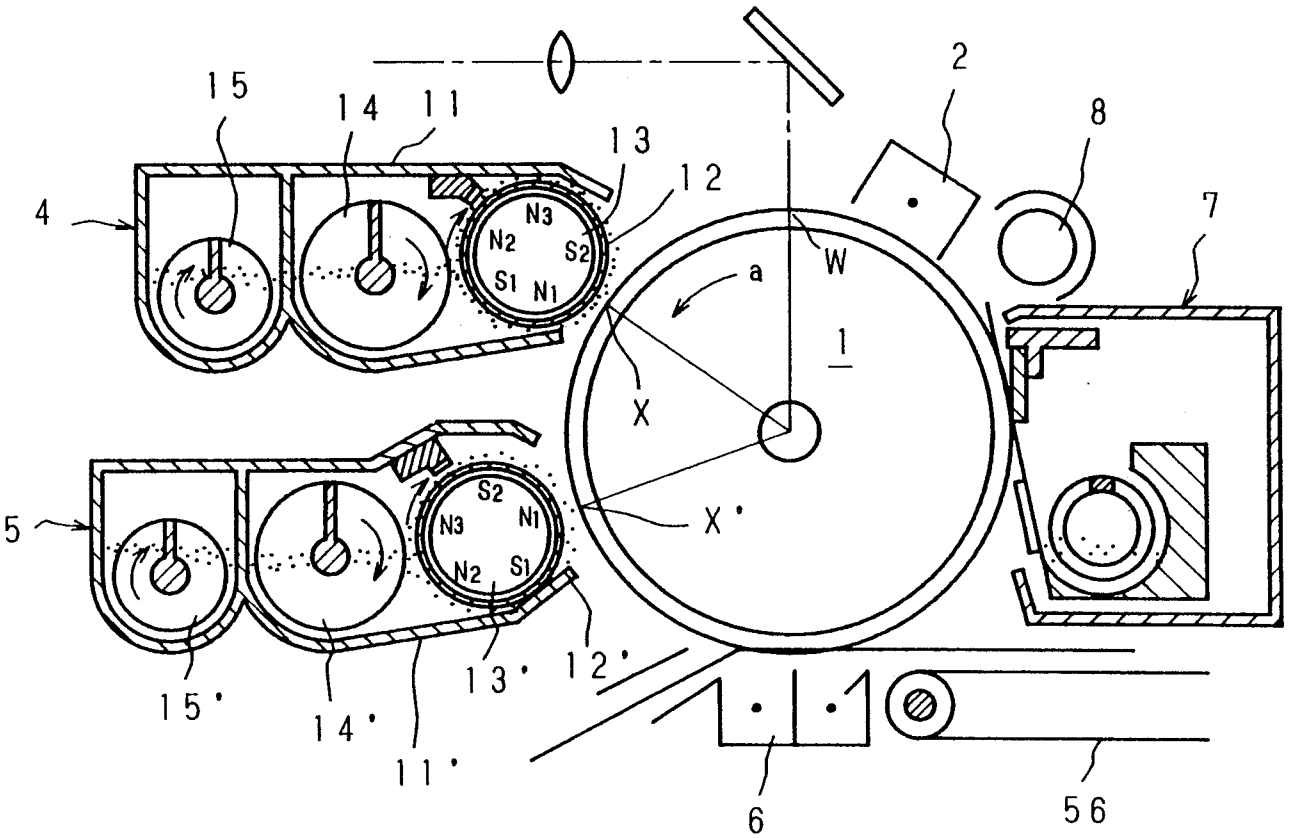
FIG. 2 is a magnified view of a main part thereof.

FIG. 2 is a magnified side cross-sectional view of a main part of FIG. 1, specifically the periphery of the photosensitive drum 1.

The first developing device 4 and the second developing device 5 have nearly the same configuration. In a developing tank 11 (11'), a developing sleeve 12 (12'), a feed roller 14 (14') and a screw 15 (15') are mounted in sequence from the photosensitive drum 1 side. A developer composed of magnetic carriers and insulative color toner is stored in the first developing device 4, and a developer composed of magnetic carriers and insulative black toner normally used is stored in the second developing device 5.

Inside the developing sleeve 12 (12'), a magnet roller 13 (13') wherein a plurality of magnets are extended in the axial direction is provided, and the magnetic forces of magnetic poles $N_1$, $N_2$, $N_3$, $S_1$ and $S_2$ located on the outer peripheral surfaces of these magnets are set to $N_1=1000$ G, $N_2$, $N_3=500$ G, and $S_1$, $S_2=800$ G, respectively (G is an abbreviation of Gauss).

Figure 4:
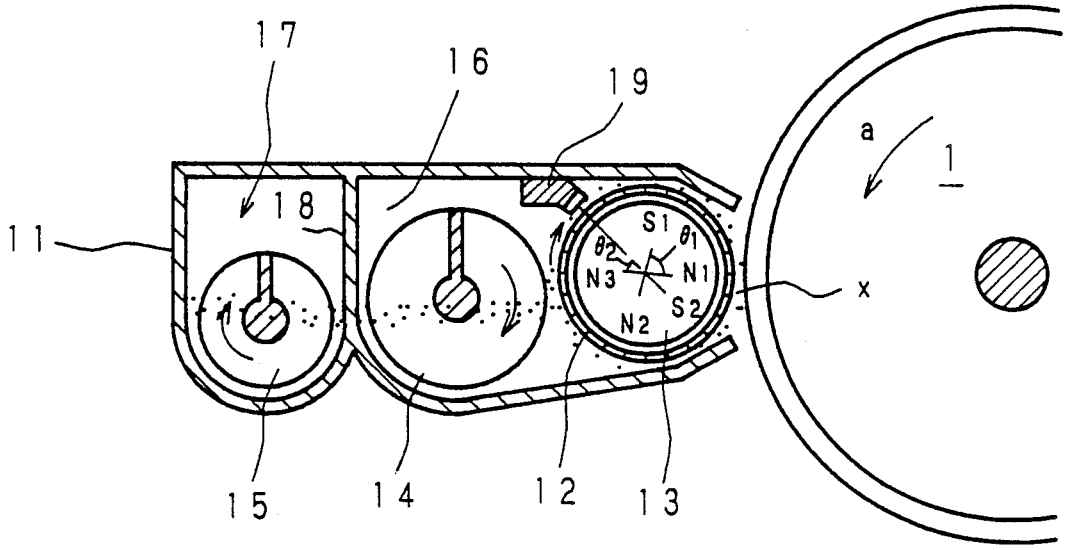
FIG. 4 and FIG. 6 are longitudinal cross-sectional views of the developing device in the operated state and the non-operated state, respectively.

Then, as is obvious from a side cross-sectional view as shown in FIG. 4, the center of the magnetic pole $N_1$ is disposed at the position at an angle of $\theta_1$ (80°) clockwise from the center of the magnetic pole $S_1$. The magnetic pole $N_3$ is disposed in a manner that the center thereof is positioned at an angle $\theta_2$ (40°) counterclockwise from the opposite part of a brush height controlling member 19 in the state that the magnetic pole $N_1$ faces the photo sensitive drum 1.

Figure 3:
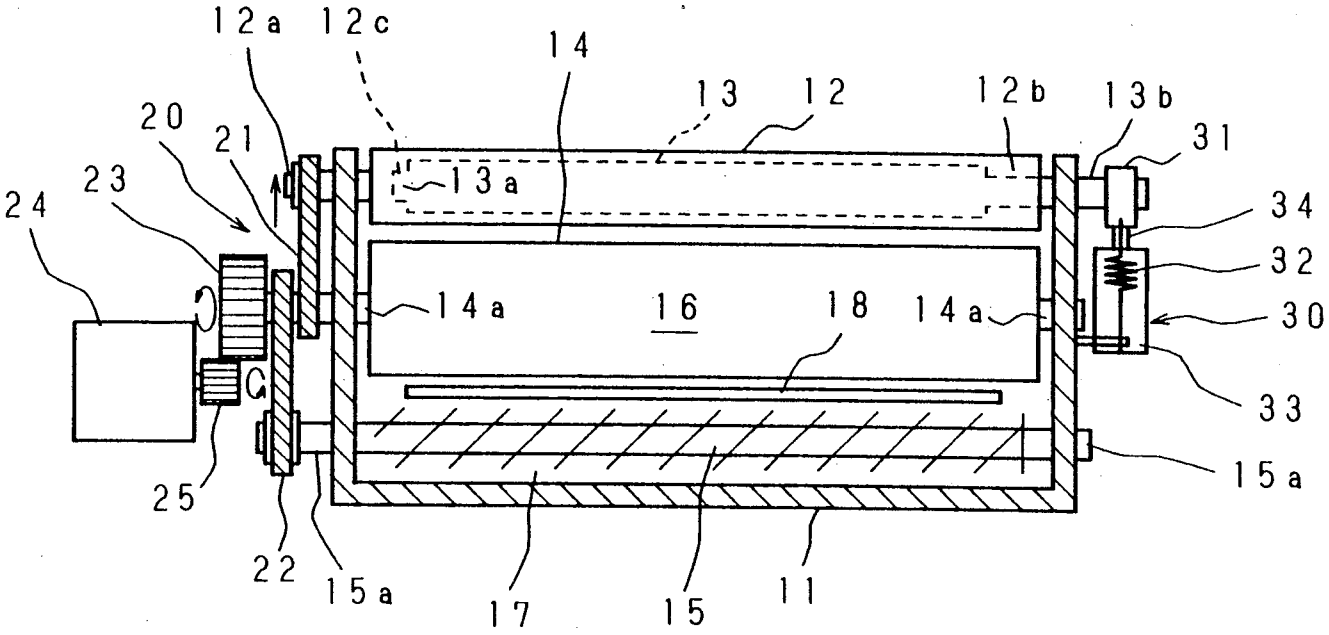
FIG. 3 is a longitudinal cross-sectional view showing a configuration of a developing device of the image forming apparatus of the present invention.

FIG. 3 is a plan cross-sectional view of the developing device. The magnetic roller 13 is mounted in a manner that one end part 13*a* of the support shaft thereof is supported by a bearing recess 12*c* provided inside the developing sleeve 12, and the other end part 13*b* of the same is supported by the side wall of the developing tank 11, and is made rotatable by a predetermined angle $\theta_1$ (=40°) by moving means 30 as described later. On the other hand, the developing sleeve 12 is mounted in a manner that a right-side bearing part 12*b* in FIG. 3 is supported by the support shaft 13*b* of the magnet roller 13 and an opposite-side of the support shaft 12*a* is supported by the side wall of the developing tank 11, and is rotation-driven by driving means 20.

The feed roller 14 and the screw 15 are mounted in carrying paths 16 and 17 partitioned by a partition wall 18, respectively. Those roller 14 and screw 15 are mounted in a manner that respective support shafts 14*a* and 15*a* are journaled by the side wall of the developing tank 11, and is rotation-driven by the driving means 20.

In addition, as shown in FIG. 3, the carrying paths 16 and 17 are connected with each other at the both sides of the developing tank 11.

Figure 5:
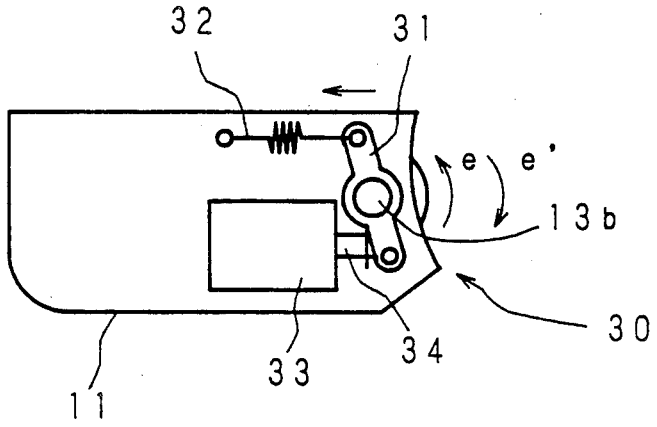
FIG. 5 and FIG. 7 are side cross-sectional views showing a configuration of moving means of a magnet roller.
Figure 7:
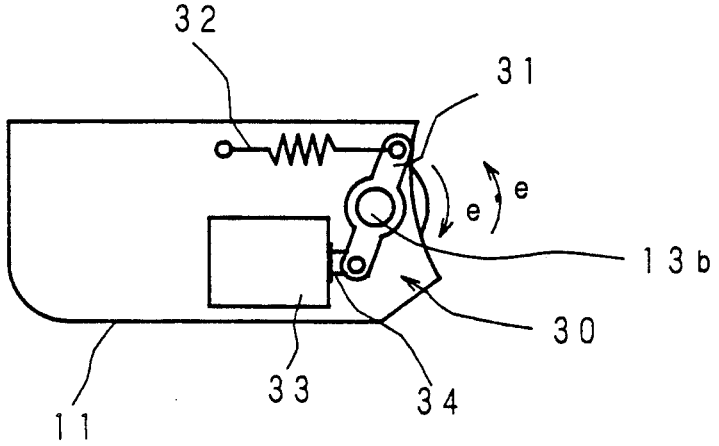

The moving means 30 of the above-mentioned magnet roller 13 is constituted with a lever 31, a spring 32 and a solenoid 33 as the side views thereof are shown in FIG. 5 and FIG. 7. The intermediate portion of the lever 31 is fixed to the end portion of the support shaft 13*b* of the magnet roller 13, and one end portion thereof is attached to one end of the spring 32 which is fixed to the developing tank 11 and is always forced in the direction as shown by an arrow e. Also, a plunger 34 of the solenoid 33 is hooked at the other end portion of the lever 31, and by driving the solenoid 33, the lever 31 is rotated in the direction as shown by an arrow e' against the force of the spring 32.

When the solenoid 33 is not operated, that is, when the lever 31 is in the state as shown in FIG. 5, as shown in FIG. 4, the magnet pole $N_1$ of the magnet roller 13 faces the photosensitive drum 1, and the magnetic pole $N_3$ retreats to the position at an angle $\theta_2$ (40°) counterclockwise from the part facing the brush height controlling member 19. In this state, a magnetic brush formed on the developing sleeve 12 with the developer is in contact with the surface of the photosensitive drum 1, and the developing device is in the state capable of operation.

Figure 6:
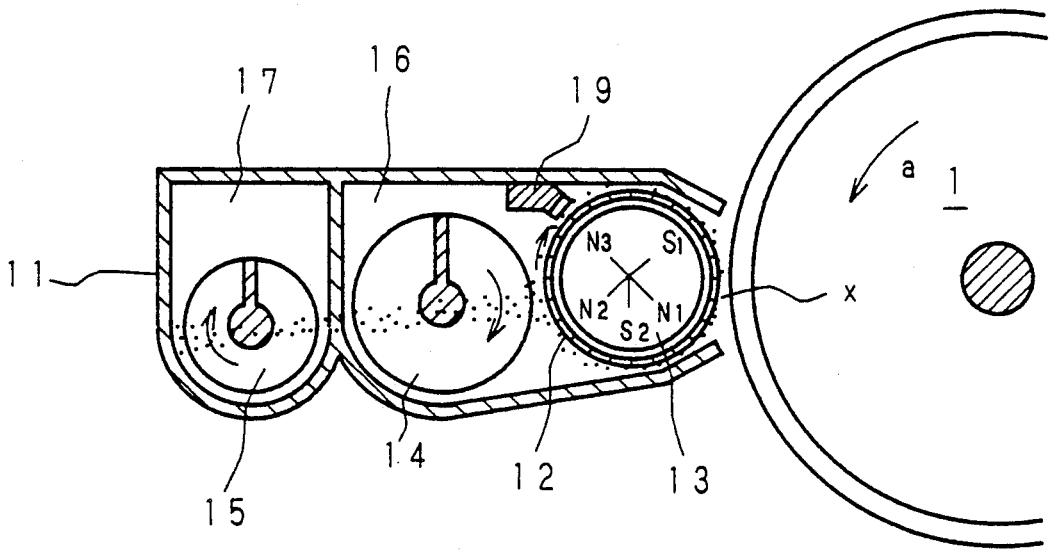

On the other hand, in the non-operated state of the developing device, the solenoid 33 is driven, and the lever 31 is put in the state as shown in FIG. 7, and as shown in a longitudinal cross-sectional view in FIG. 6, the magnetic pole $N_3$ faces the brush height controlling member 19, and the intermediate part between the magnetic poles $N_1$ and $S_1$ faces the part facing to the photosensitive drum 1.

At this intermediate part between the magnetic poles $N_1$ and $S_1$, the magnetic brush of the developer is not formed, and the developer does not contact the surface of the photosensitive drum 1 in this state, and therefore development of the electrostatic latent image on the surface of the photosensitive drum is not performed.

Figure 8:
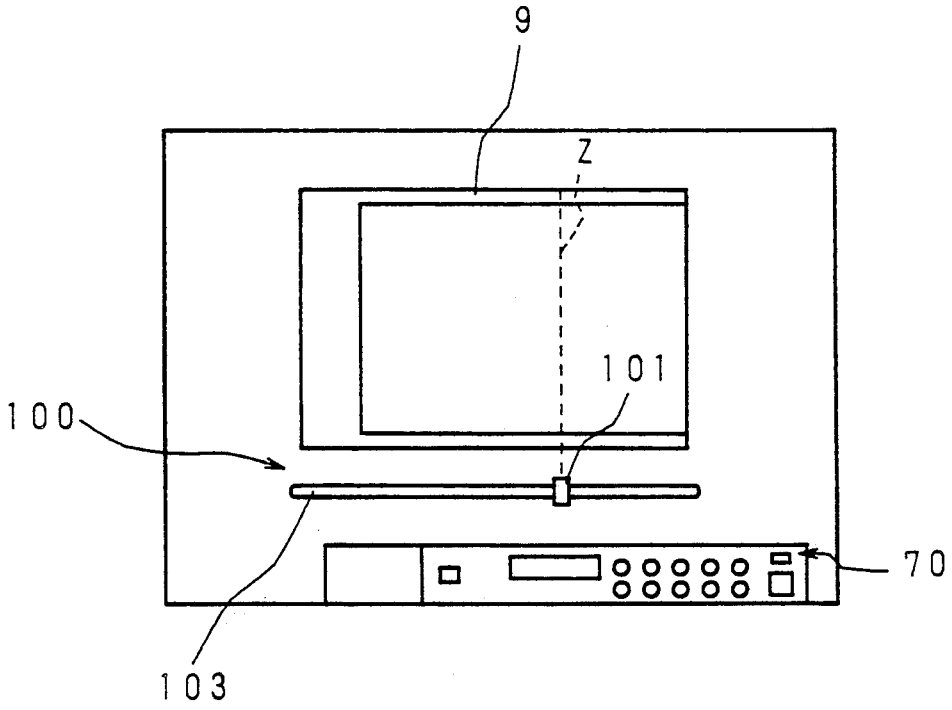
FIG. 8 is a schematic plan view of the image forming apparatus of the present invention.

FIG. 8 is a schematic plan view of the copying machine. On the top surface of the copying machine, an image editing mechanism 100 is mounted which is provided with the document glass plate 9, an operation panel 70 and a lever 101 which selects the position of change-over of the developing device (color) in performing simultaneous multicolor copying. The lever 101 can be moved along a groove 103 provided along the side edge of the document glass plate 9 and in the scanning direction of the scanner 40. When the simultaneous multicolor copying is performed, the lever 101 is set at an arbitrary position, and thereby control is performed by a controlling circuit as described later in a manner that the developed color is changed-over at a boundary line Z appointed by the lever 101.

Figure 9:
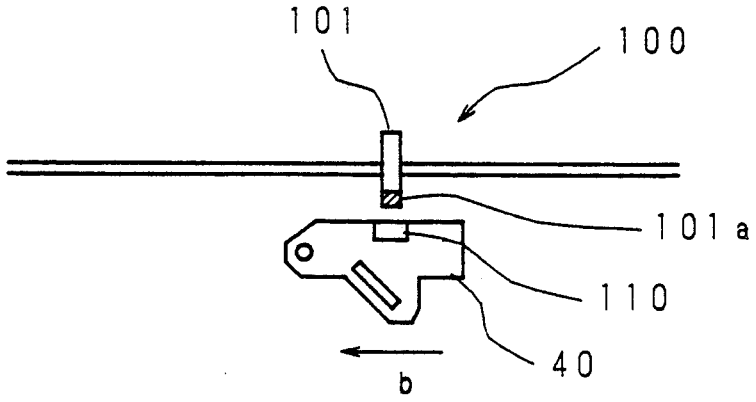
FIG. 9 is a side cross-sectional view showing a configuration of an image editing mechanism.

FIG. 9 is a side cross-sectional view of the image editing mechanism, and under the lever 101, a magnet 101*a* is provided at the portion located inside the body of the copying machine.

On the other hand, in the scanner 40 of the optical system 3, a reed switch 110 is provided which outputs a predetermined signal to a controlling apparatus when the magnet 101*a* is detected.

Also, as shown in FIG. 1, the initial set position of the scanner 40 is detected by a reed switch 500 located under the scanner 40.

Figure 10:
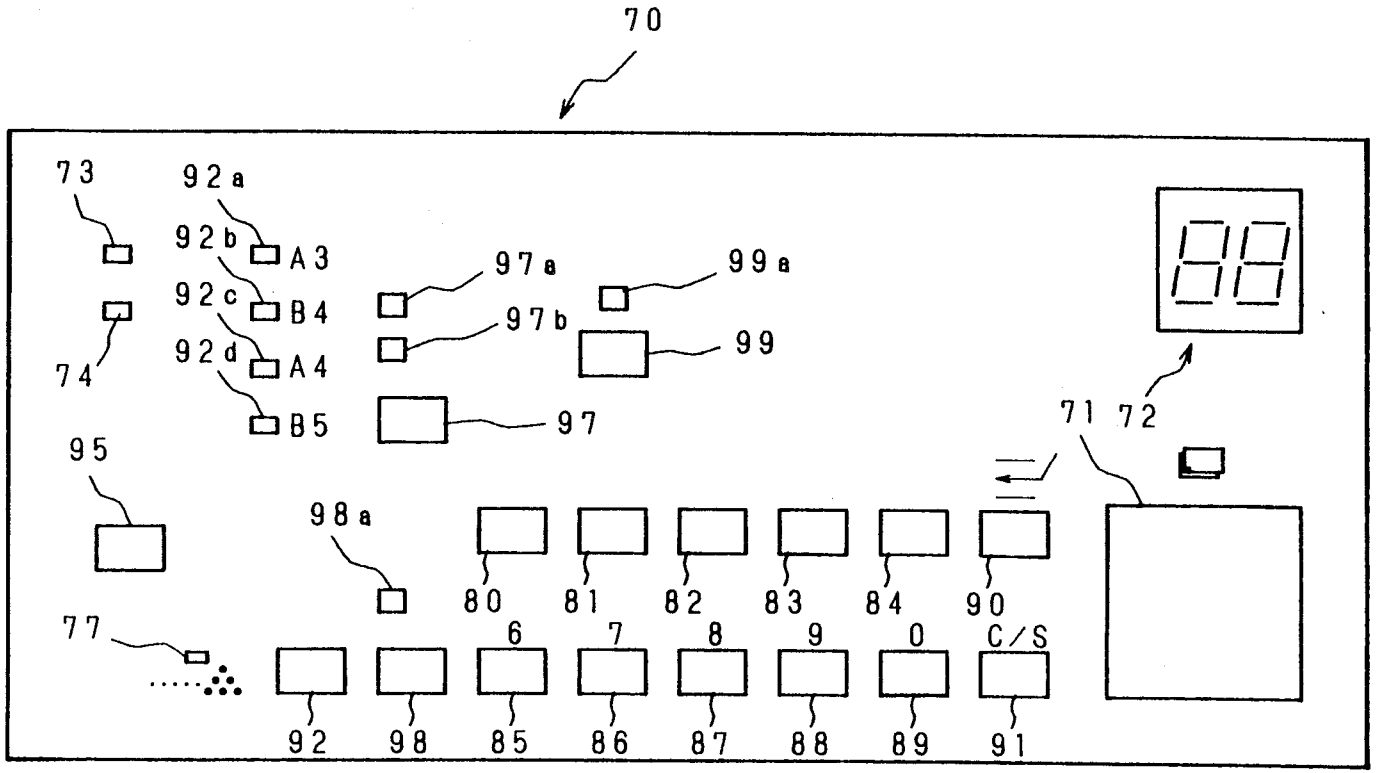
FIG. 10 is a schematic diagram showing a configuration of an operation panel of the image forming apparatus of the present invention.

Next, description is made on the operational panel 70 of the copying machine in reference to a plan view as shown in FIG. 10.

In the operation panel 70, numeral 71 designates a print key, numeral 72 designates numeric displaying LED for displaying the copy quantity, numerals 73 and 74 designate LEDs for displaying toner colors, and the LEDs 73 and 74 display operations of the first developing device and the second developing device, respectively. Numeral 77 designates an LED for displaying toner empty. Numerals 80 through 89 designate tenkeys, numeral 90 designates an interrupt key performing an interrupt command, numeral 91 designates a clear/-stop key, numeral 92 designates a paper select key, and numerals 92*a* through 92*d* designate LEDs for displaying paper size selection, which display paper sizes A3, B4, A4 and B5 respectively. Numeral 95 designates a key for selecting the first developing device or the second developing device, numeral 97 designates a key for selecting a simultaneous two-color copy mode, numeral 97*a* designates an LED for displaying the simultaneous two-color copy mode, which displays on-state of the key for selecting the simultaneous two-color copy mode, numeral 97*b* designates an LED for displaying the reverse mode in the simultaneous two-color copy mode. Mode selection is performed in a sequence of the monochrome copy mode (97*a* and 97*b* are not lit), the simultaneous two-color mode (97*a* is lit) and the reverse mode (97*b* is lit) every time the simultaneous two-color mode select key 97 is depressed. By depressing this key once more, the monochrome copy mode is restored.

Also, numeral 98 designates a key for selecting book split copy mode, numeral 98*a* designates an LED for displaying selection of the book split copy mode, numeral 99 designates a key for selecting the double-side mode, and numeral 99*a* designates an LED for displaying selection of the double-side mode.

Figure 11:
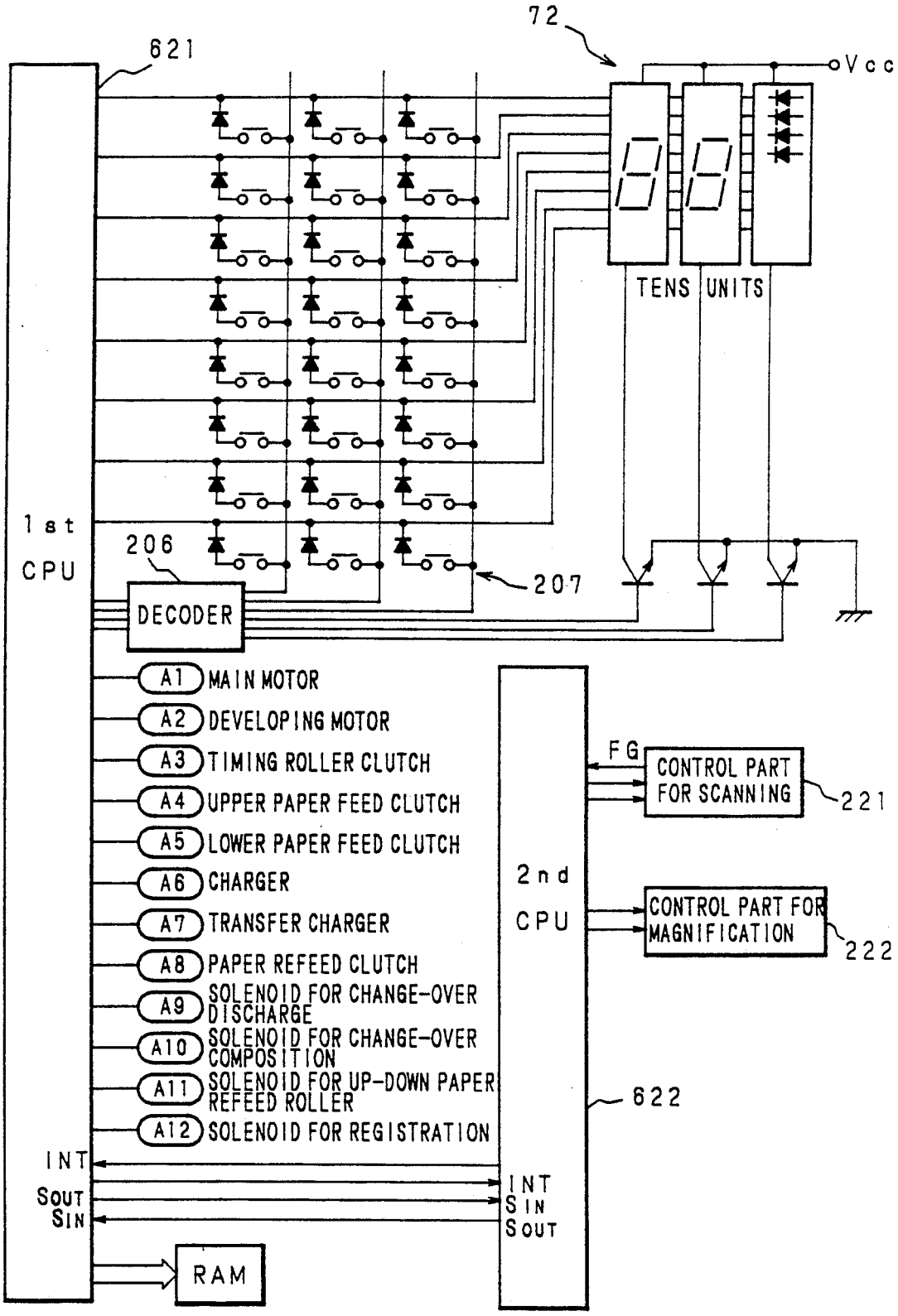
FIG. 11 is a circuit diagram showing a configuration of a controlling system of the image forming apparatus of the present invention.

Next, description is made on a controlling circuit of this copying machine in reference to a circuit diagram in FIG. 11.

This controlling circuit is constituted with a first microcomputer (CPU) 621 for controlling copying operation and a second microcomputer (CPU) 622 for controlling the optical system which are connected to each other to be synchronized with each other and a RAM 623, and to the first CPU 621, a switch matrix 207 is connected wherein various operation keys on the operation panel 70, the sensors such as the reed switch and the scanner 40 initial position switch 500 are provided.

Also, to output terminals A1 through A12 of the first CPU 621, a main motor, a developing motor, a paper feed clutch, a paper re-feed clutch, a solenoid for changing-over the lever and the like are connected, and based on signals from the above-mentioned switch matrix 207, ON and OFF of them are controlled.

Furthermore, to the first CPU 621, various LEDs of the copy quantity display part 72 and the like are connected through a decoder 206, and lighting and putting-out thereof are controlled.

On the other hand, to the second CPU 622, a drive control part 221 of a DC motor for scanning the optical system and a drive control part 222 of a stepping motor for moving a lens are connected.

Next, description is made on control sequence of the controlling circuit constituted as described above based on flow charts in FIG. 12 through FIG. 18.

Before the description of the control sequence, the terms "on edge" and "off edge" will be defined.

When the states of a switch, sensor, signals and so on changes from the off state to the on state, this change of state will be defined as "ON edge". When the states of the switch, sensor, signals and so on changes from the on state to the off state, the change of state is defined as "OFF edge".

Figure 12:
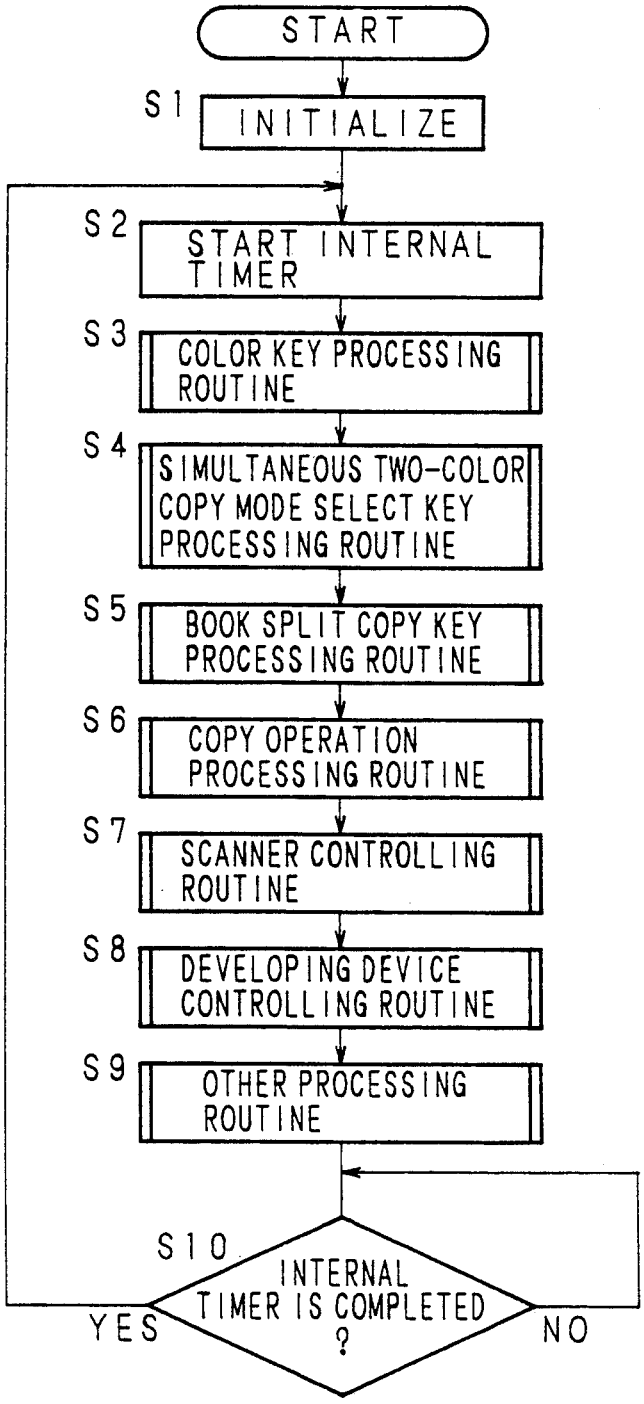
FIG. 12 through FIG. 18 are flow charts showing controlling procedures by the control of the image forming apparatus of the present invention.

A main routine as shown in FIG. 12 shows a control sequence of the whole of the copying machine performed by the first CPU 621, and by turning on the power source of the copying machine, the CPUs 621 and 622 inside it is initialized at Step S1.

At Step S2, a predetermined value is set in an internal timer, and the timer is started, so that one routine time for performing the subsequent processings is set. This means that in this copying machine, this sequence of the main routine is executed every routine time, which is a minute time.

At Step S3, a color key processing routine is executed. Here, the operation state of the select key 95 is judged, and when either of the first or the second developing devices 4 or 5 is selected, processing of lighting the LED 73 or 74 indicating the toner color of the developing device 4 or 5 is performed.

Subsequently, at Step S4, a simultaneous two-color copy made select key processing routine is executed. In this routine, the operation state of the simultaneous two-color copy mode select key 97 is judged, and when the simultaneous two-color copy mode or the reverse mode by simultaneous two-color copy as described later is selected, processing of lighting the LED 97*a* or the both LED 97*a* and LED 97*b* indicating that selection is performed.

At Step S5, a book split copy key processing routine is executed.

In a routine of processing copy operation of Step S6, the standard copying operation or the simultaneous two-color copying operation is executed.

At Step S7, a scanner controlling routine is executed.

At Step S8, a developing device controlling routine is executed.

The above-mentioned routines of Step S5 through Step S8 are detailed later.

At Step S9, other processings are executed, and at the following Step S10, judgment is made on whether or not time counting of the internal timer set in the above-mentioned Step S2 has finished, and when it has finished, processing returns again to Step S2, and when it has not finished, processing is put on wait state.

In this embodiment, the document glass plate 9 is fixed, and the exposure lamp 41 is scan-operated, but without being limited to this method, it is also possible that the exposure lamp 41 is fixed and the document glass plate 9 is scan-operated.

Figure 13:
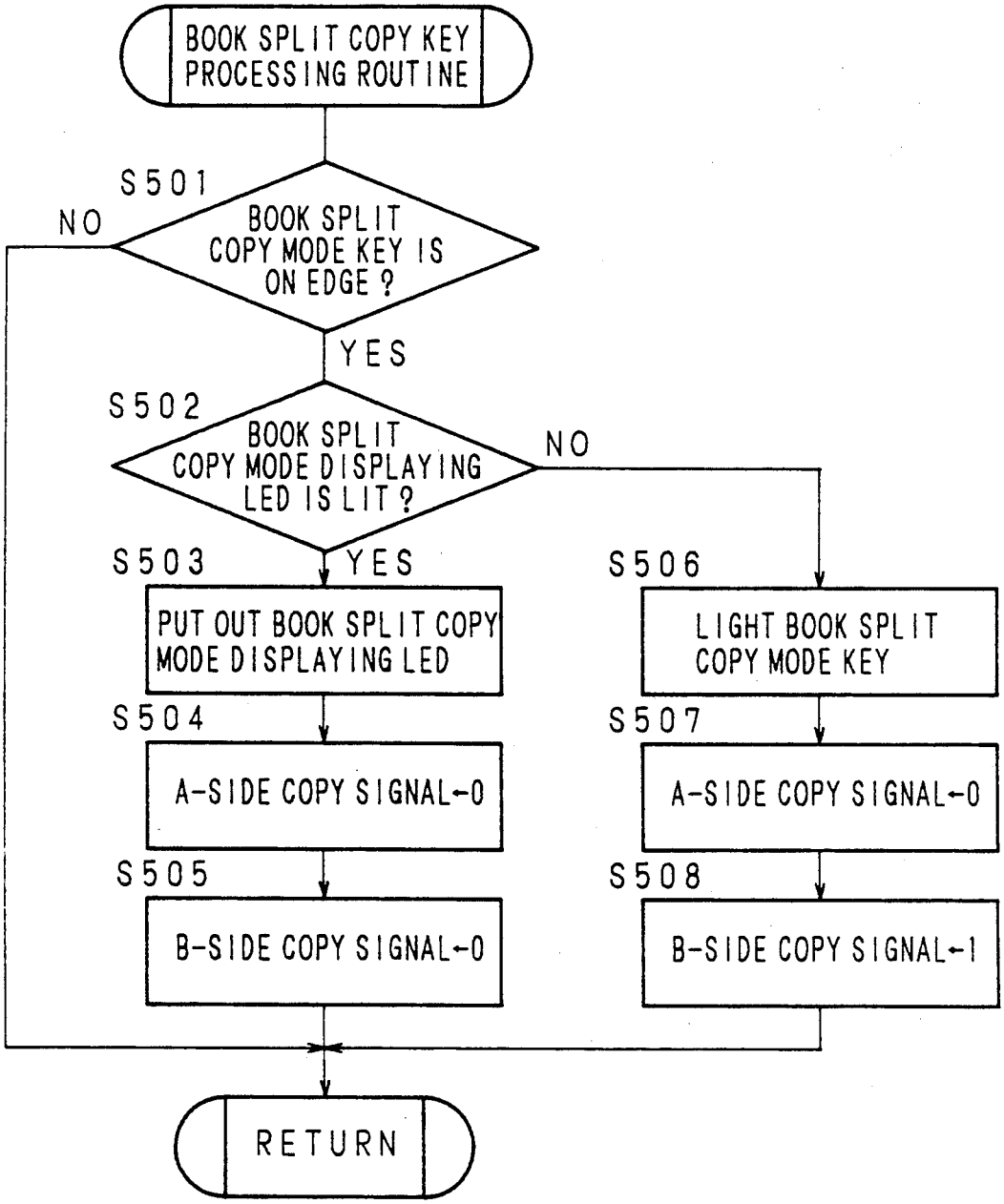

Then, FIG. 13 is a flow chart showing details of the book split copy key processing routine at the above-mentioned Step S5.

First, the first CPU 621 judges on edge of the book split copy mode select key 98 (Step S501). Where this is turned on, when the book split copy mode displaying LED 98*a* is put out, the first CPU 621 lights this (Step S506), turns an A-side copy signal to "0", and thus a B-side copy signal to "1", and processing returns to the main routine (Steps S507 and S508).

Here, the A-side is a page located on the right side of a marker 90 when a book is opened and placed on the document glass plate 9 with the opened pages facing downward, and the B-side is a page located on the left side in that state.

On the other side, when the book split copy mode displaying LED 98*a* is lit at Step S502, the first CPU 621 puts out this (Step S503), and sets the both A-side and B-side copy signals to "0", and processing returns to the main routine (Steps S504 and S505).

Figure 14A:
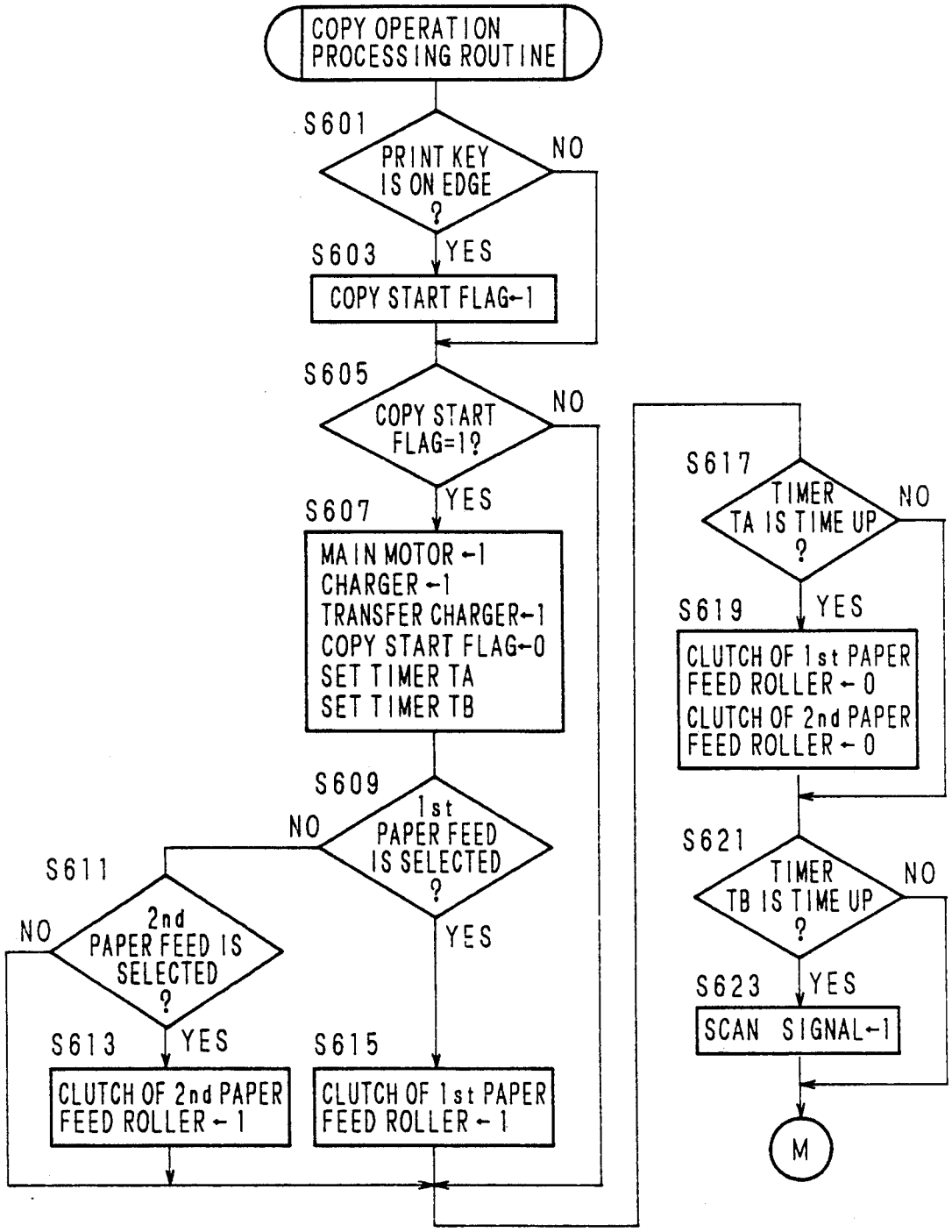
Figure 14B:
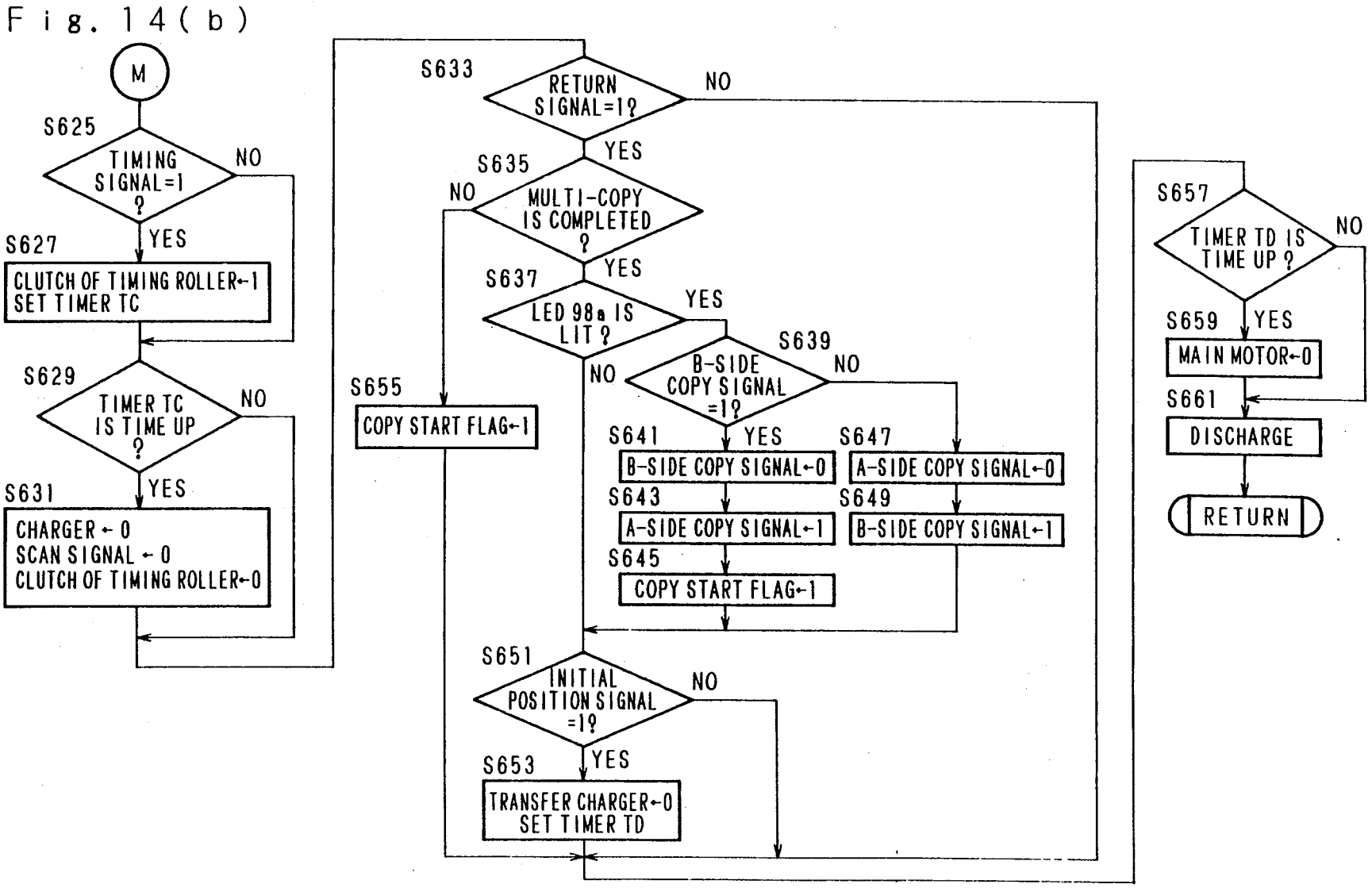

FIG. 14(*a*) and (*b*) are flow charts showing details of the routine of processing copying operation at the above-mentioned Step S6.

Copying operation processing is started by detecting an input of the print key 90 (Step S601).

First, the first CPU 621 sets a copy start flag to "1" (Step S603), and judges the setting of the flag (Step S605), and thereafter puts a main motor (not illustrated), the charger 2 and the transfer charger 6 in on-state respectively, and sets timers TA and TB, and resets the above-mentioned copy start flag to "0" (Step S607). Here, the timer TA manages off-time of the clutches of the paper feed rollers 57 and 58, and the timer TB manages scan-start-time.

In the following Steps S609 through S615, the first CPU 621 starts feeding copy sheets by turning on the clutch of the paper feed rollers 57 and 58 of the selected cassette, either the upper cassette 50 or the lower cassette 51.

Subsequently, at Step S617, the first CPU 621 judges end of time counting of the above-mentioned timer TA, and when the judged result is "end", it stops feed of copying paper by turning off the clutch of the paper feed rollers 57 and 58 previously turned on (Step S619).

Subsequently, at Step S621, the first CPU 621 judges end of time counting of the timer TB, and when the judged result is "end", it sets a scan start signal (scan signal) to "1" (Step S623), and starts scanning processing as described later.

At Step S625, the first CPU 621 judges a timing signal, and when detecting that this is "1", it turns on the clutch of the timing roller 52, feeds copy sheet between the photosensitive drum 1 and the transfer charger 6, starts transfer onto the copy sheet, and sets a timer TC (Step S627). The timer TC manages scan-end-time, charge-end-time and off-time of the clutch of the timing roller 52 (Steps S629 and S631), and the set time thereof is determined according to the size of copy sheet selected at Steps S609 through S611 and the set copy magnification.

Subsequently, at Step S633, the first CPU 621 judges whether or not a return signal is "1". When this is "1", return is started. When multi-copy is completed (Step S635), the first CPU 621 judges whether or not the book split copy mode has been designated from lighting of the LED 98*a* (Step S637). When the mode is the book split copy mode, the first CPU 621 judges whether or not the B-side copy signal is "1" (Step S639). Here, the B-side copy refers to a first copy in the book split copy mode, and the A-side copy is a second copy.

When the B-side copy signal is "1" (Step S639), the first CPU 621 turns the B-side copy signal to "0", and sets the A-side copy signal to "1" (Steps S643 and S645), sets a copy start flag, and prepares for performing the A-side copy as a second copy (Step S645). Also, when the B-side copy signal is not "1" (Step S639), the A-side copy signal is "1", so that therefore the first CPU 621 sets the A-side copy signal to "0" (Step S647), and sets the B-side copy signal to "1" (Step S649).

Subsequently, when the scanner 40 is restored to the initial position, and an initial position signal is delivered (Step S651), the first CPU 621 turns off the transfer charger 6, and sets a timer TD (Step S653). The timer TD manages off-time of the main motor (Step S657 and S659).

In addition, when multi-copy has not been completed at Step S635, the first CPU 621 sets the copy start flag (Step S655), and executes the copying operation again.

Subsequently, at Step S661, the first CPU 621 outputs each control signal to control external equipment, and transmits signals to the other CPU.

The copying operation is performed as described above.

Figure 15:
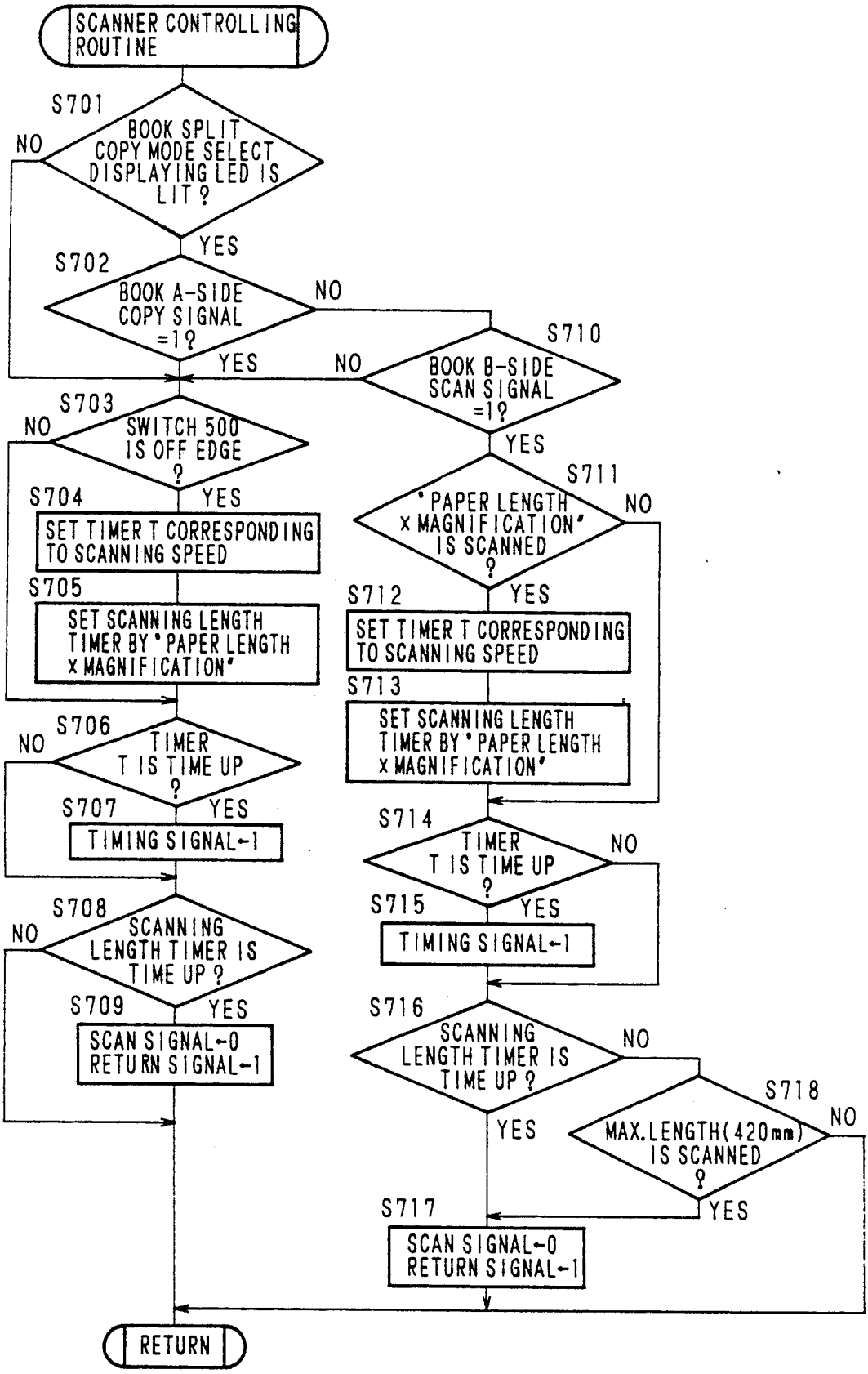

FIG. 15 shows a scanner controlling routine (Step S7).

When the book split copy mode select displaying LED 98*a* is not lit (Step S701), that is, in the case of the normal copy mode, or when the book split copy mode select displaying LED 98*a* is lit (the book split copy mode) and in the case of A-side scanning (Step S702), normal scanner control is performed. This means that when the scanner parts from the scanner initial positon switch 500 (Step S703), the first CPU 621 sets a timer T for registration with paper corresponding to the scanning speed and a scanning length timer is determined by paper "length×magnification" (Steps S704 and S705). When time counting of the timer T is completed (Step S706), the first CPU 621 sets the timing signal to "1" (Step S707), and when time counting of the scanning length timer is completed (Step S708), it sets the scan signal to "0", and sets the return signal to "1" (Step S709). In the case of the book B-side scanning (Step S710), scanning is performed across a distance of paper length×magnification (Step S711), and then the same processing as the above-mentioned case is performed (Step S712–S717). Note that when the scanner 40 reaches the longest scanning length (420 mm in this embodiment) before time counting of the scanning length timer is completed, the scanner 40 finishes scanning (Step S18), and starts return to the initial position.

Figure 16A:
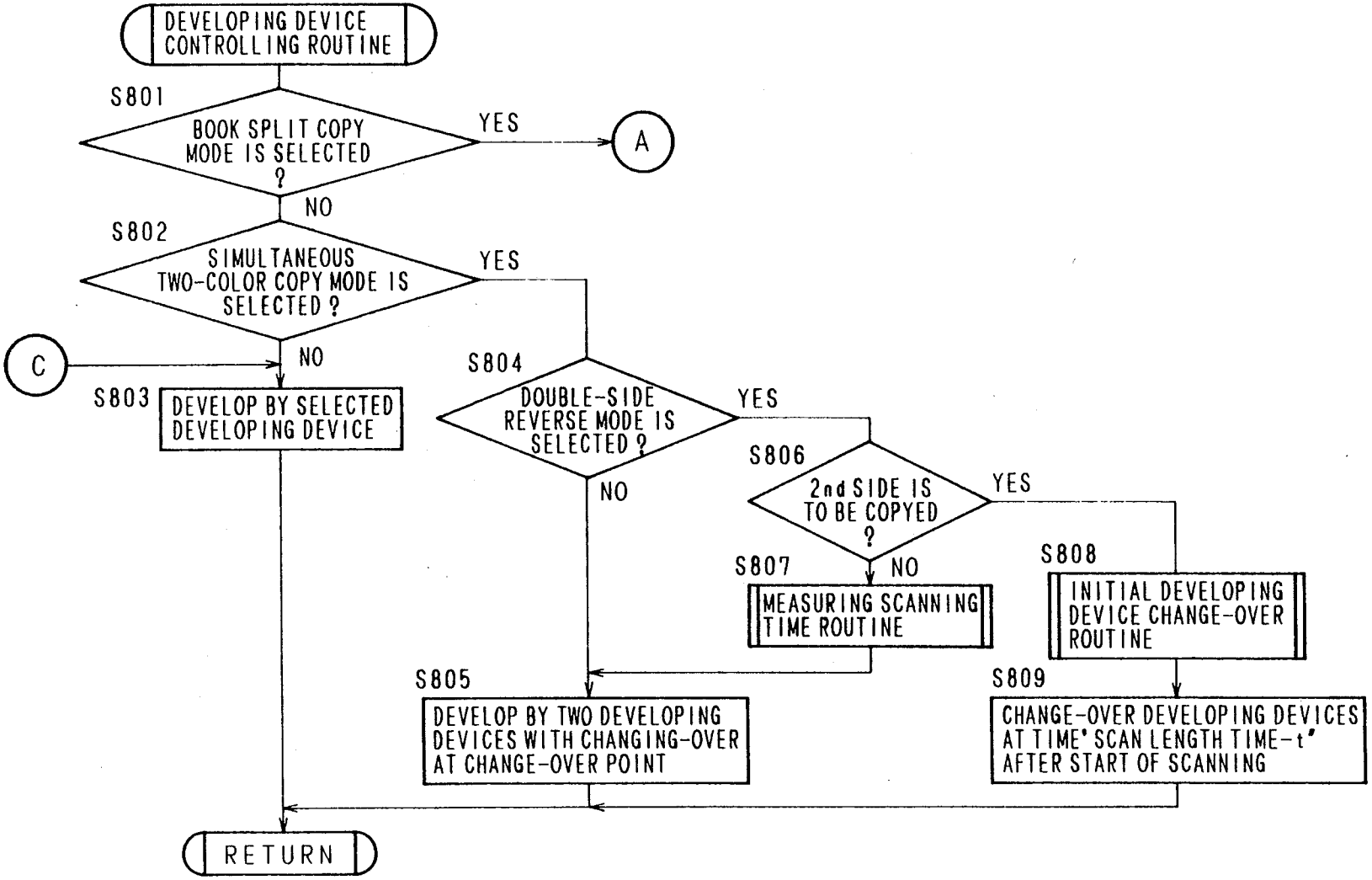
Figure 16B:
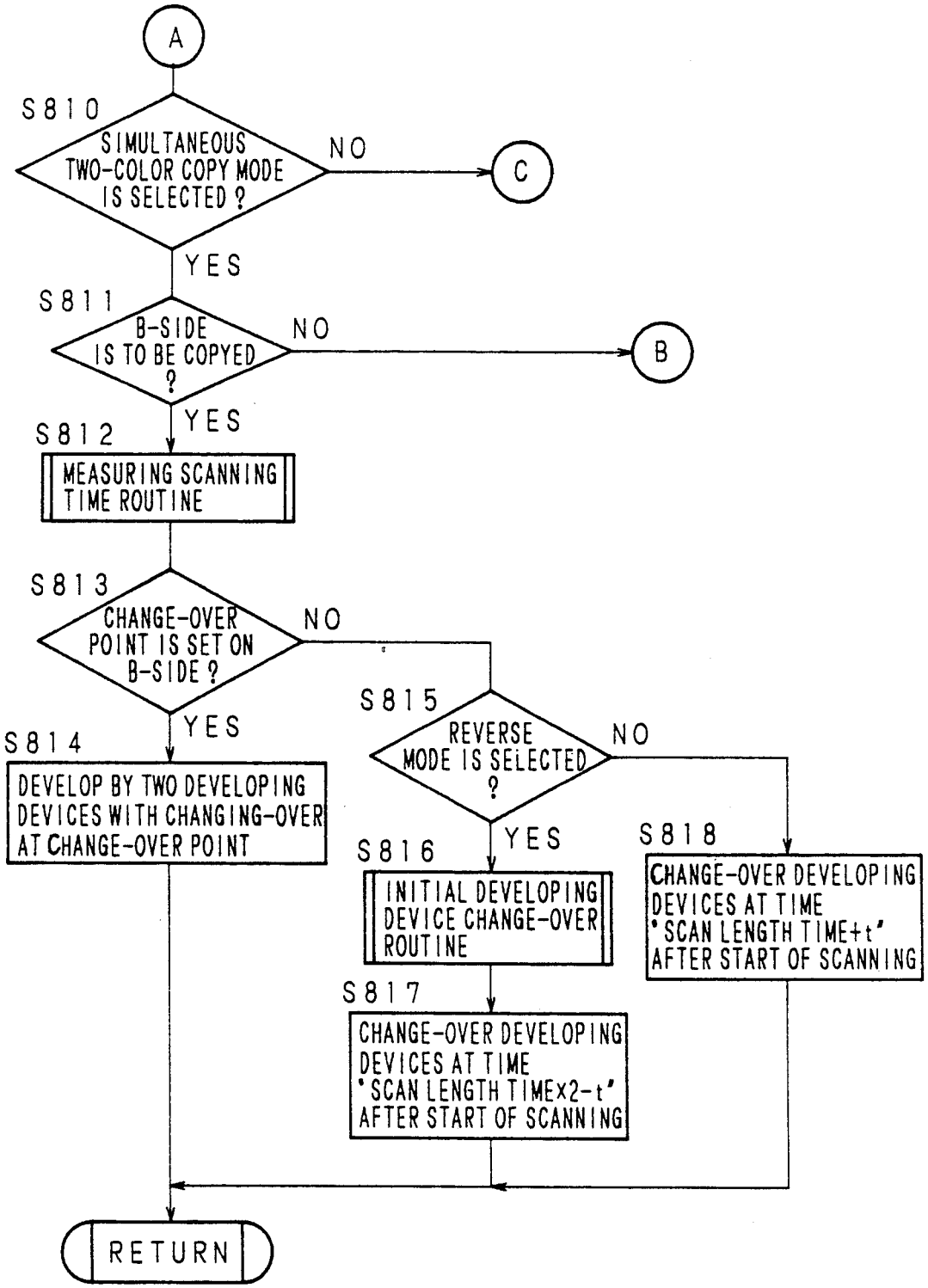
Figure 16C:
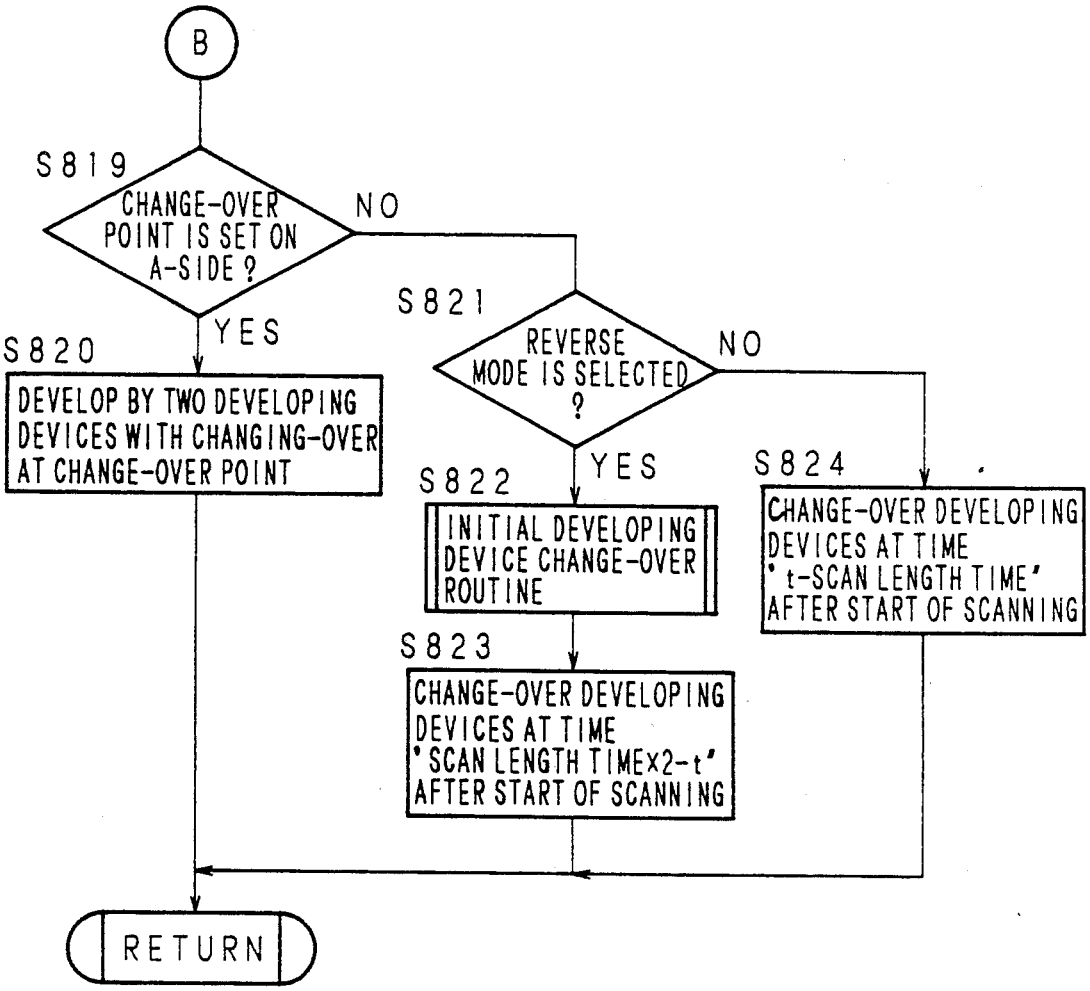

FIG. 16(*a*) through FIG. 16(*c*) show a developing device controlling routine (Step S8).

First, the first CPU 621 judges whether or not the book split copy mode has been selected (Step S801), and when this has not been selected and also the simultaneous two-color copy mode has not been selected, development is performed by the selected developing device, either the first or the second developing device, attending on normal copying operation (Step S802 and S803).

On the other hand, when the simultaneous two-color copy mode has been selected at Step S802, the first CPU 621 judges whether or not the double-side reverse mode has been selected (Step S804), and when this mode has not been selected, development is performed by changing-over the first and the second developing devices with the change-over point of developed color set by the lever 101 as a boundary (Step S805).

Control of changing-over the developing devices is performed in a manner that the developing devices are driven to be changed-over by a change-over signal generated by off edge of the reed switch 110 in the normal simultaneous two-color copy mode, and by a change-over signal generated by a lapse of a predetermined time in the memory mode or the reverse mode as described later.

However, at this point of time, the image position where the above-mentioned change-over signal is generated is located at a position W of the photosensitive drum 1, and therefore the following control is performed.

In the case of change-over from the second developing device 5 to the first developing device 4, the first CPU 621 turns off the magnetic pole change-over solenoid 33 at a timing of a time lapse ($t_1$=0.22sec) during which the image position at change-over moves to the development position X of the first developing device 4, and turns on the developing motor 24 of the first developing device 4.

Thereby, the first developing device 4 is set in the state as shown in FIG. 4 and FIG. 5 like the second developing device 5, and the developing sleeve 12, the feed roller 14 and the screw 15 are rotated in the directions as shown by arrows respectively, and on the surface of the developing sleeve 12, a magnetic brush is formed, and is set in the state capable of developing an electrostatic latent image on the photosensitive drum 1. Then, in the first developing device 4, operation of feeding color toner to the electrostatic latent image corresponding to the color region is started.

Subsequently, after a time $t_2$ from start of a first developing motor 24, that is, at a timing of a time lapse ($t_2$=0.20sec) during which the above-mentioned intermediate position moves from the development position X to the development position X' of the second developing device 5, the first CPU 621 turns off a second developing motor 24', and turns off a magnetic pole change-over solenoid 33'. By the above-described processing, the development for the block region is completed, and the development for the color region is started.

Change-over from the first developing device 4 to the second developing device 5 is executed by above-mentioned change-over signal. At this time, however, the image position where the change-over signal is generated locates at the position of W on the photosensitive drum 1, so that the first CPU 62 turns o the first developing motor 24 and turns on the magnetic pole change-over solenoid 33 at the timing of a time lapse $t_1$ (=0.22 sec) as like as above. Further, the first CPU 621 turns on the second developing motor 24' and turns off the magnetic pole change-over solenoid 33' at the timing of a time lapse $t_2$ (=0.20 sec). By the above-description processing, the developing for the color region is completed, and the development for the black region is started.

Figure 19:
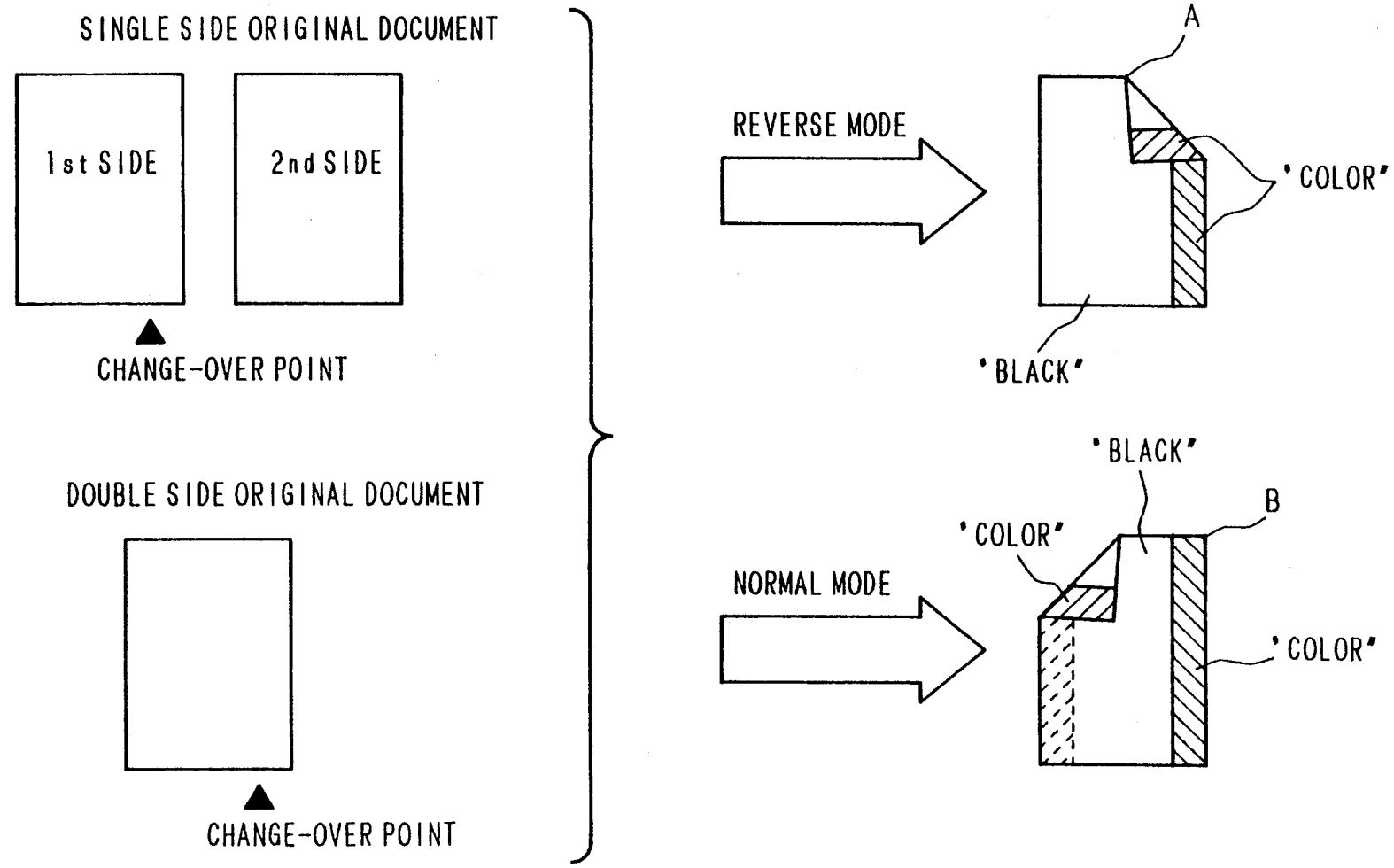
FIG. 19 and FIG. 20 are schematic diagrams showing operation in each mode of the image forming apparatus of the present invention.
Figure 20A:
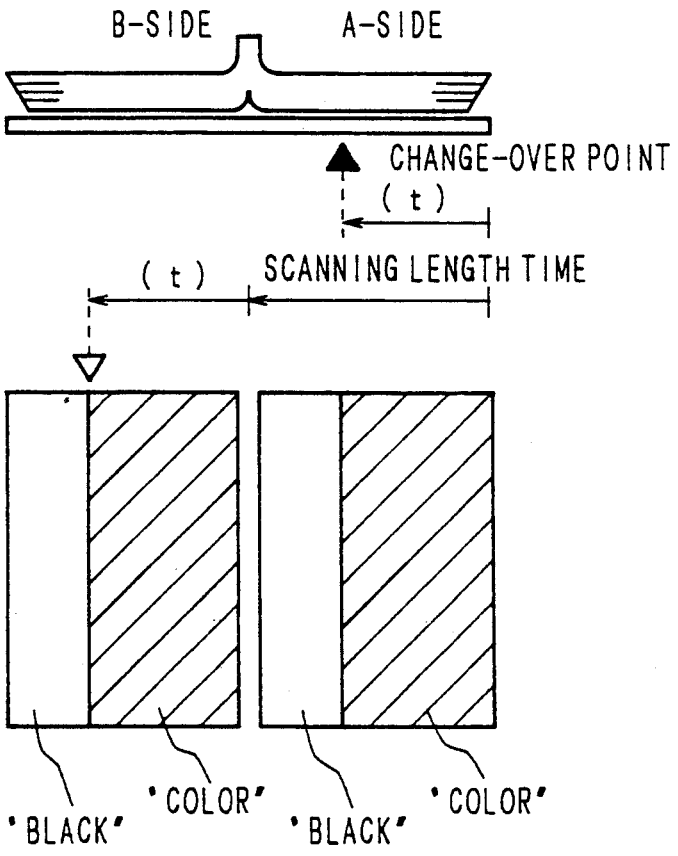
Figure 20B:
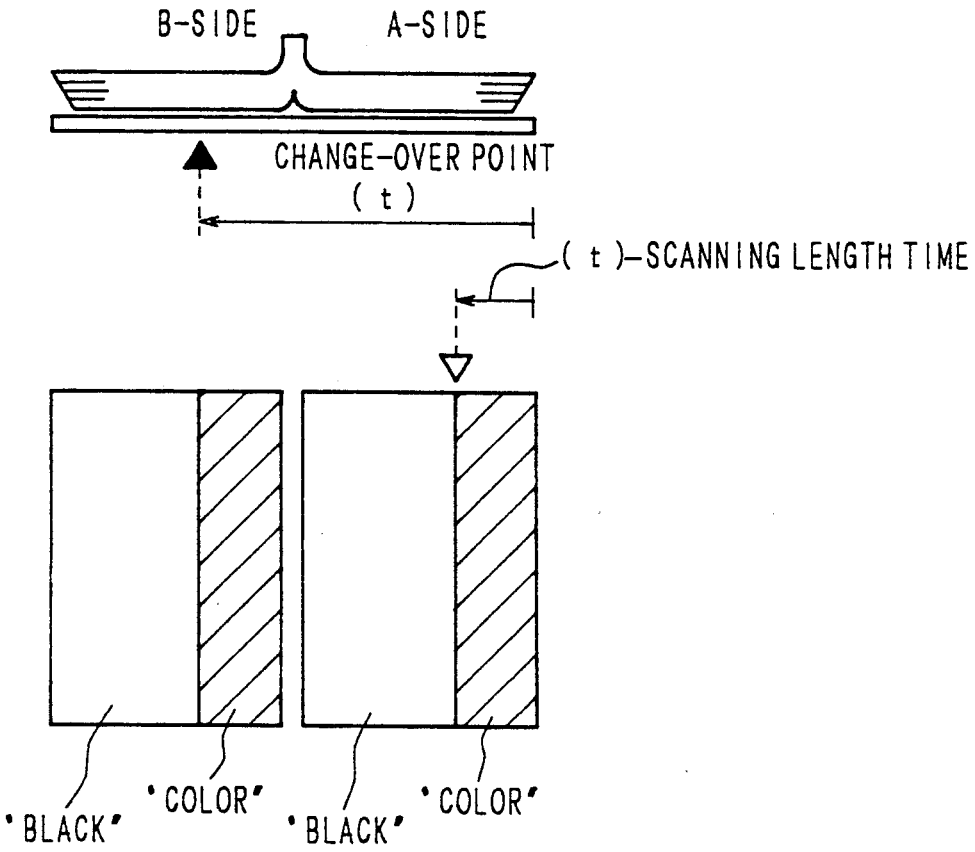
Figure 20C:
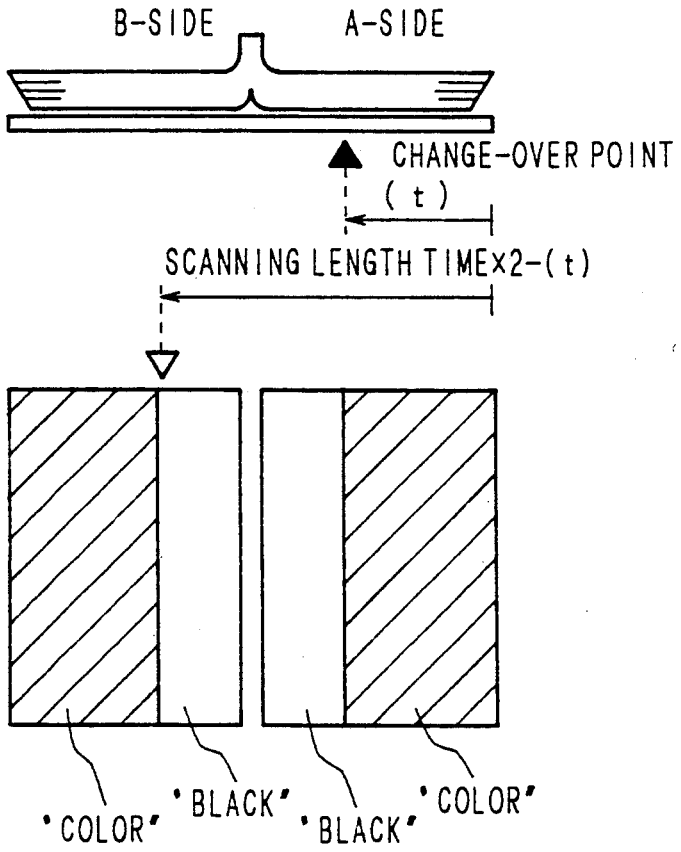
Figure 20D:
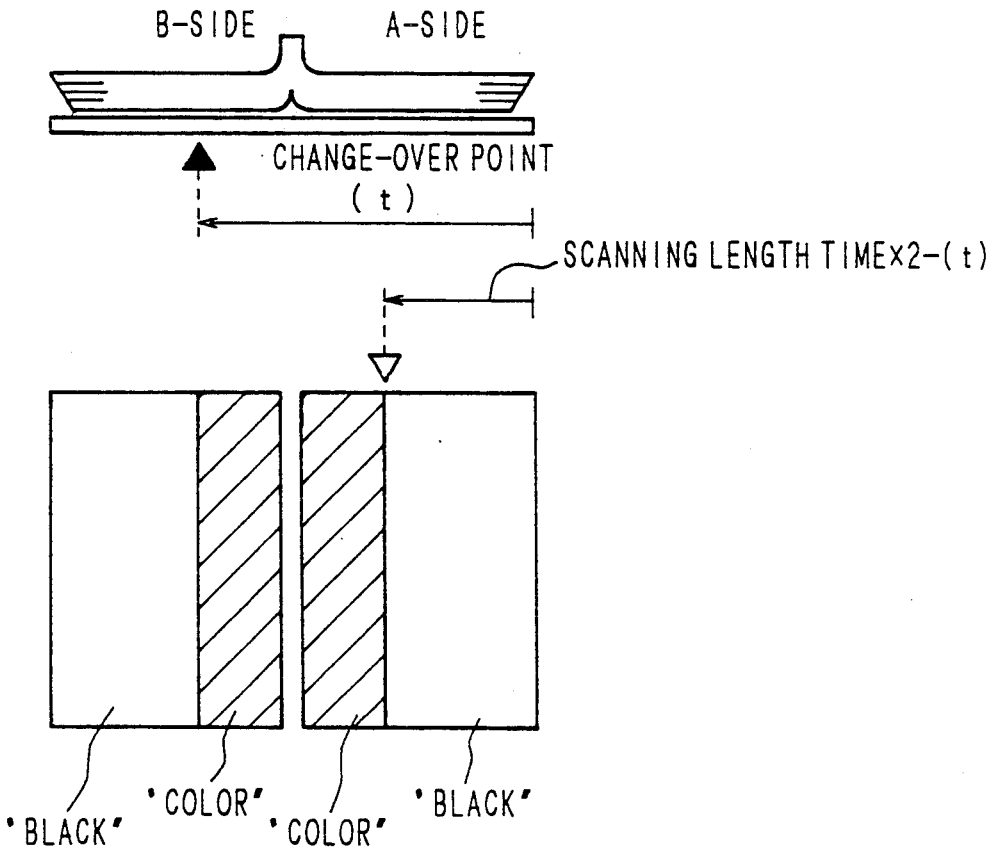

Here, the double-side reverse mode refers to the case where the double-side mode and the reverse mode based on the simultaneous two-color mode are both selected, and as shown in an explanatory view of FIG. 19, where one sheet of double-side copy is obtained from two sheets of single-side documents or one sheet of double-side copy is obtained from one sheet of double-side document, the developed color of the side to be copied secondly is reversed from the first one, and the change-over thereof is performed symmetrically with the center position located at the center of scanning length of the original document. This means that as shown by A in FIG. 19, by this method, images can be formed with the same color in the same regions (hatched) of the both sides of a double-side copy, and for example, indexes positioned at the same-side ends of the both sides can be color-identified.

In the case Where this double-side reverse mode is selected, the first CPU 621 judges whether a first side copy or a second side copy is performed (Step S806), and when the initial first side copy is performed, the first CPU 621 measures a scanning time (t) up to the change-over point and stores by a subroutine of measuring scanning time (Step S807), and similarly at Step S805, performs a first development by changing-over the first and the second developing devices 4 and 5 with the change-over point taken as a boundary.

Figure 17:
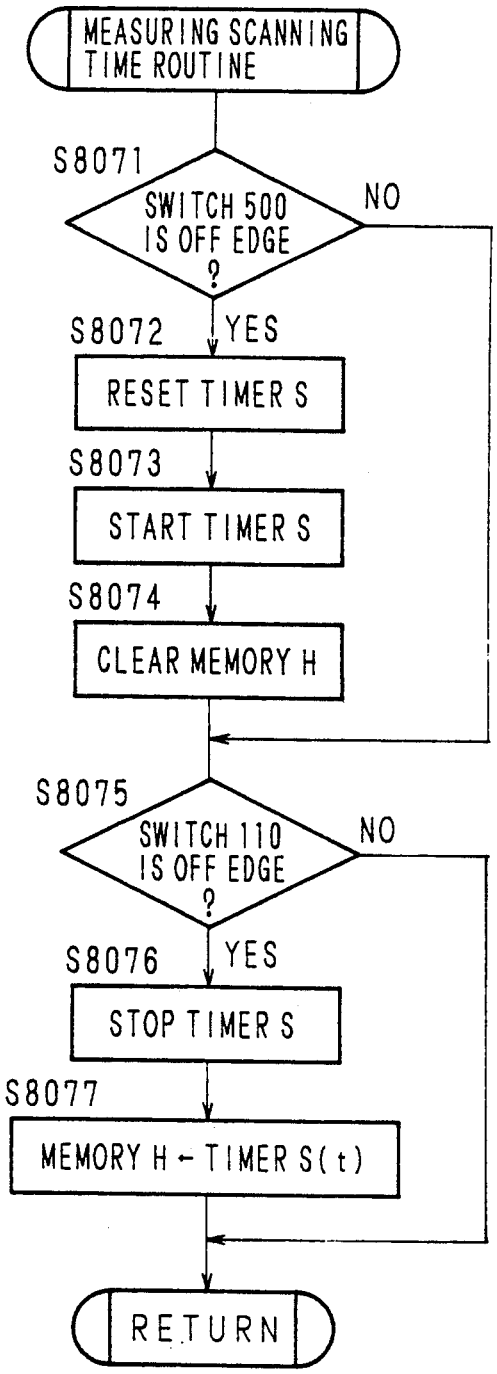

FIG. 17 is a flow chart showing the contents of the subroutine of measuring scanning time for measuring and storing the above-mentioned scanning time (t) used at Steps S807 and S812. First, when a start of scanning is detected by off edge of the scanner initial position switch 500 (Step S8071), the first CPU 621 resets a timer S, and thereafter starts it to start timer counting, and clears a memory H (Steps S8072 through S8074).

Then, when the change-over point of the developed color is detected by off edge of the reed switch 110 (Step S8075), the first CPU 621 stops the timer S, and stores the time counting value (t) in the memory H (Step S8076 and S8077).

Then, in a second side copy by the double-side reverse mode, first, the first CPU 621 executes a subroutine of changing-over the initial developing device of Step S808, and starts development by changing-over the initial developing device with the one used for the first side copy. This means that the developing device changed-over midway in the first side copy is used initially (Step S808).

Figure 18:
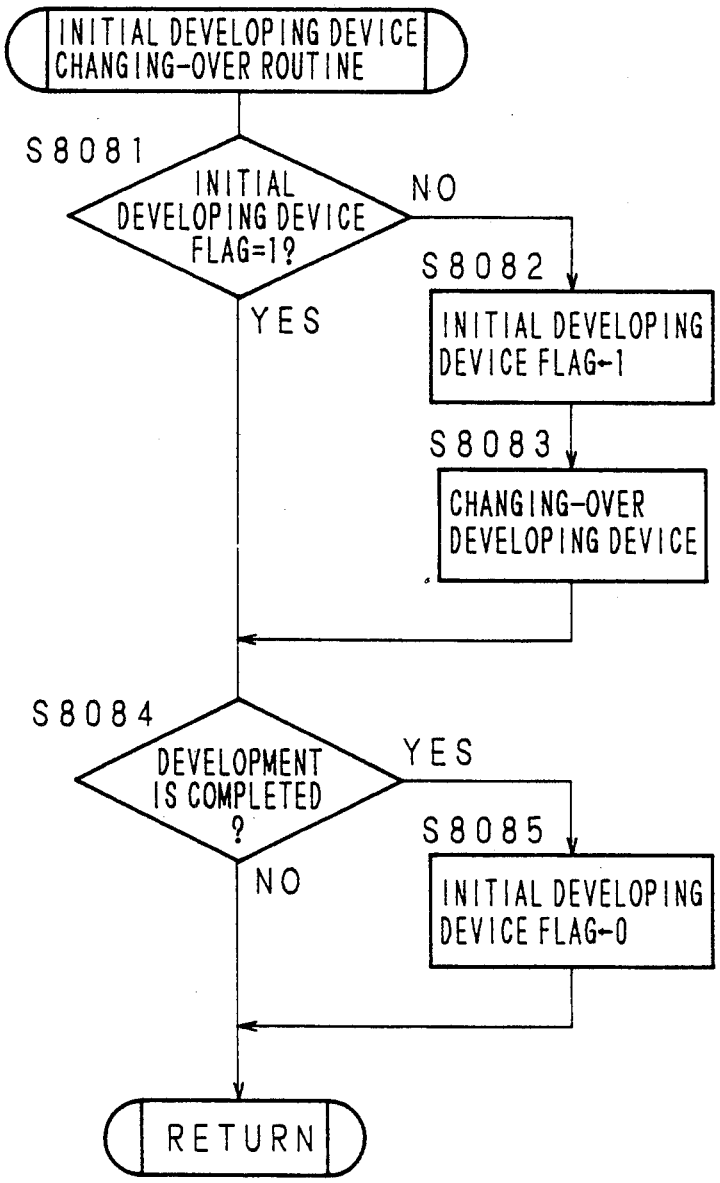

FIG. 18 shows the contents of this subroutine of changing-over the initial developing device. First, where an initial developing device flag is not "1", the first CPU 621 sets it to "1", changes-over the initial developing device, and starts development (Step S8081–S8083), and when the development is completed, it resets the initial developing device flag to "0" (Step S8084 and S8085).

After the initial developing device has been changed-over and the development of the second side has been started as described above, when a timer required for scanning the original document subtracted by the scanner time (t) stored in the above-mentioned memory H has elapsed from the start of scanning, a change-over signal is generated and control of change-over of the developing device is performed (Step S809).

Thus, the copy as shown by A in FIG. 19 is obtained.

In addition, when the mode is normal mode other than the reverse mode, a copy as shown by B in FIG. 19 is obtained.

On the other hand, where the book split copy mode has been selected in the above-mentioned Step S801, as shown in FIG. 16(*b*), the first CPU 621 judges next whether or not the simultaneous two-color copy mode has been selected (Step S810), and when this mode has not been selected, processing proceeds to the above-mentioned Step S803, and development by normal book split mode is performed by the selected developing device.

Where the simultaneous two-color copy mode has been selected in the book split copy mode, the first CPU 621 judges next whether or not the B-side is copied, that is, as described above, whether or not a first copy is performed (Step S811), and when the B-side is copied, it executes the measuring scanning time routine as shown in FIG. 17, and measures the scanning time (t) up to the change-over point, and stores it (Step S812). The scanning time (t) in this case is set by adding the scanning time up to the change-over point on the B-side to the moving time of the scanner 40 on the A-side when the change-over point exists on the B-side so that this time (t) can accommodate for either case where the change-over point is set on the B-side or the A-side. This means that this time (t) is a time of movement of the scanner 40 from the initial set position of the scanner 40 to the change-over point irrespective of the A-side or the B-side.

Subsequently, the first CPU 621 judges that on which of the A-side or the B-side the change-over point has been set (Step S813). When it has been set on the B-side, the first CPU 621 develops the B-side by changing-over the first and the second developing devices with the change-over point as a boundary (Step S814). For a judgment of Step S813, for example, a method is used wherein a time taken for scanning a distance of "paper length×magnification" is measured, and whether off edge of the reed switch 110 is detected during this time is checked, and when off edge is detected, it is judged that the change-over point exists on the A-side, and when not detected, it is judged that the point exists on the B-side.

Also, when the point has been set on the A-side, the first CPU 621 judges whether or not the reverse mode has been selected (Step S815), and when the reverse mode has not been selected, control of change-over of the developing device is performed by generating a change-over signal when the scanning length time of the A-side (time taken for scanning a distance of "paper length×magnification") added by the above-mentioned scanning time (t) has elapsed from a start of scanning, and thereby development of the B-side is performed (Step S818).

On the other hand, when the reverse mode has been selected, the first CPU 621 executes the routine of changing-over the initial developing device as described above to change-over the initial developing device, and starts development of the B-side (Step S816), and changes-over the developing device by generating a change-over signal when two times of the scanning length time, that is, the scanning length time of the A- and B-sides subtracted by the above-mentioned scanning time (t) has elapsed from a start of scanning (Step S817).

By the above/mentioned processing, a first development for the B-side in the simultaneous two-color copy mode in the book split mode is performed. FIG. 20(*a*) through FIG. 20(*d*) are explanatory views thereof. In this embodiment, for the initial developing device in the normal simultaneous two-color copy, the one provided with color toner is used, and the developing device provided with black toner is used from the change-over point.

In addition, where the change-over point exists on the A-side, the scanning time (t) has not been measured at a start of scanning, but calculation of timing of change-over of the developing device is performed at a point when measurement is completed on the A-side, and therefore simultaneous two-color copy can be performed by one-time scan.

FIGS. 20(*a*) and (*b*) show a mode wherein change-over of the image color is performed at equal positions on the A-and B-sides (hereinafter referred to as the memory mode), and where a change-over point has been set on the A-side, as shown in FIG. 20(*a*), the image color of the B-side is changed-over at a change-over point obtained by calculation.

Also, where the change-over point has been set on the B-side, as shown in FIG. 20(*b*), the image color of the B-side is changed-over at that change-over point .

FIGS. 20(*c*) and (*d*) show the reverse mode, that is, the mode wherein change-over is performed by which the A- and B-sides have image colors symmetrical with the center marker position located center, and where the change-over point has been set on the A-side, as shown in FIG. 20(*c*), the initial developing device is changed-over with the one provided with black toner, and the image color of the B-side is changed-over to color at the change-over point obtained by calculation.

Also, where the change-over point has been set on the B-side, as shown in FIG. 20(*d*), the image color of the B-side is changed-over at that change-over point like the case of FIG. 20(*b*).

Thus, the operator may set the change-over point on either of the A-side or the B-side, and on the side where the change-over point of a copy to be obtained finally has not been set, change-over of the image color responding to the selected memory mode or reverse mode is performed.

When the development of the B-side is completed as described above, to perform a second development for the A-side, the CPU 621 judges that copy is performed on the A-side at Step S811 in FIG. 16(*b*), and processing proceeds to Step S819 in FIG. 16(*c*), and the side where the change-over point has been set is discriminated. Here, where the change-over point has been set on the A-side, the first CPU 621 performs development of the A-side by changing-over the developing devices with that change-over point as a boundary. This means that this is the above-mentioned case of FIGS. 20(*a*) and (*c*).

On the other hand, where the change-over point has been set on the B-side, the first CPU 621 judges whether or not the reverse mode has been selected (Step S821), and when the reverse mode has not been set, that is, the memory mode has been set, it performs development for A-side by changing-over the developing devices by generating the change-over signal when the stored scanning time (t) subtracted by the time of scanning length of the A-side has elapsed from a start of scanning (Step S824). This is the above-mentioned case of FIG. 20(*b*), and the position of the mark becomes the change-over point obtained by calculation.

Also, in the reverse mode, the first CPU 621 changes-over the initial developing device, and starts development for the A-side (Step S822), and like the above-mentioned Step S817, changes-over the developing devices by generating the change-over signal when two times of the scanning length time subtracted by the above-mentioned scanning time (t) has elapsed from a start of scanning (Step S823). This is the case of FIG. 20(*d*), and the initial developing device is changed-over with the one provided with black toner, and the image color of the A-side is changed-over with color at the change-over point obtained by calculation.

As a result of the above processing, particularly the reverse mode is optimum for color-identifying indexes of a book wherein the indexes are positioned at the right and left end parts of the both opened pages, and only by selecting the position of change-over of the index portion of one page, change-over of the index portion of the other page can be performed automatically.

In addition, this embodiment is constituted in a manner that measurement of the scanning time up to the change-over appointed position is performed at a first scan, but this time may be measured at preliminary scan before copying operation. Also, it is also possible that means for detecting the position of the lever 101 is provided separately, and from the result of this detection, the scanning time up to the change-over selected position or the position of change-over of the developing device other than this position is calculated.

Furthermore, in this embodiment, control of changing-over the developing devices is performed by measuring the scanning time, but it is also possible that means for detecting the position of the scanner is provided, and it detects that the scanner has reached the change-over selected position or another change-over position calculated based on the selected position, and thereby similar control is performed.

Also, in this embodiment, when the simultaneous two-color copy mode is selected in the book split mode, change-over of the developed color is performed always on both the A-side and the B-side, but a configuration may be adopted which can select the mode of changing-over the developed color only at the position selected by the lever 101.

Also, by utilizing the present invention, it is also made possible that the developing devices are changed-over at a plurality of positions in one-time scanning operation based on this selected position by selecting only one position of change-over of the developed color. By applying this configuration, it is also made possible that, for example, where both pages of an opened book are copied on one side of copy paper by one-time scanning operation, only by appointed the changed-over position by selecting means so that the index portion of one page is color-identified, the index portion of the other page located at the position symmetrical therewith is color-identified automatically.

As detailed above, in the image forming apparatus in accordance with the above described embodiment, for example, in the case of the double-side copy performing copying processing on the both sides of a copying paper from two sheets of original document or from a double-side document or in the case of performing the split edit copy of a book or the like, the change-over position of the developing devices is set only on one sheet of original document for the double-side composite copy from two sheets of original document, only on one opened page for a book, or only on one side for a double-side document respectively, and thereby the developing devices are changed-over at another position related to the change-over position automatically set for the other sheet of original document, the other page or the opposite side. By this configuration, the change-over of the developed color at a plurality of positions can be performed easily without increasing the means of selecting the change-over position incurring a high cost. Also, the operation is very simple, and the copying operation mode such as the book split copy or the double-side copy can be utilized intact, and particularly, where the automatic document feeder is used, the change-over position on the other sheet of original document or on the rear side can be selected automatically at the position intended by the operator. Thus, the present invention has excellent effects.

Furthermore, the above-mentioned embodiment is constituted in a manner that the developed color is changed-over by the stop position of the lever capable of moving in the direction of scanning an original document, but without being limited thereto, for example, the present invention is applicable also to an image forming apparatus having an editing function capable of erasing an image in a selected region on an original document or extracting only an image in a designating region. Also, the method of designating a region on an original document can also be constituted in a manner that the region is designated by input of coordinates form a keyboard or an external editing apparatus.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within the meets and bounds of the claims, or equivalence of such meets and bounds thereof are therefore intended to be embraced by the claims.

What is claimed is:

1. A copying machine which is provided with a plurality of developing devices performing development respectively using developers of different colors, and forms copy images with a plurality of colors by using the different developing devices and changing said developing devices during one copying operation, comprising:

operating means for selecting a position for changing the color used in development;

detecting means for detecting the position selected by said operating means;

storing means for storing information detected by said detecting means;

change-over means for changing which developing devices is in operation;

first controlling means for controlling said change-over means so that the developing color is changed at the position selected by said operating means;

second controlling means for controlling said change-over means so that the developed color is changed at a position which differs from the position selected by said selecting means and which is based on the information stored in said storing means.

2. A copying machine in accordance with claim 1, wherein said copying machine executes a copying operation by a split mode which splits one original document image into two regions and forms the respective images on different copy sheets, respectively; and said second controlling means operates when a region not including the position selected by said operating means is copied.

3. A copying machine in accordance with claim 1, wherein said copying machine executes a copying operation by a double-side mode which forms images on the both sides of a copy sheet; and said first controlling means operates only in forming an image on a first side of a copy sheet, and said second controlling means operates only in forming an image on a second side of a copy sheet.

4. A copying machine which forms a copy image by using a plurality of developing devices with selectively changing said developing devices corresponding to a plurality of regions into which an original document image is divided in a predetermined direction, comprising:

selecting means for selecting a first position for changing said developing devices for said original document image;

calculating means which performs predetermined calculations based on the first position for changing said developing device selected by said selecting means in order to determine a second position for changing said developing device on said original document image; and controlling means for controlling a plurality of said developing devices so that the developing devices are changed corresponding to said first and second positions for changing said developing devices.

5. A copying machine in accordance with claim 4, wherein said copying machine executes a copying operation by a split mode which splits one original document image into two regions and forms the respective images on different copy sheets, respectively; and said calculating means determines said second position for changing said developing device so that the positions for changing the developing devices on said respective split images match each other.

6. A copying machine in accordance with claim 4, wherein said second position for changing said developing devices is symmetrical with said first position for changing said developing devices with respect to the center of said original document image.

7. A copying machine, comprising:

a document table for placing an original document;

scanning means for scanning the original document placed on said document table in a predetermined directions;

operating lever which is disposed in the vicinity of said document table, which can move in the direction parallel to said scanning direction, and which indicates an arbitrary position of the original document image in the scanning direction;

detecting means for detecting the position of said operating lever;

a plurality of developing devices;

developing device driving means which selectively drives a plurality of said developing devices;

first controlling means for controlling said developing driving means so that the developing device to be used is changed at time corresponding to the position of the operating lever detected by said detecting means; and second controlling means for controlling said developing device driving means at a time different from said time for changing said developing device set by said first controlling means based on said position of the operating lever detected by said detecting means.

8. A copying machine in accordance with claim 7, which has selecting means for selectively operating either one of said first and second controlling means and putting the other controlling means in the non-operated state.

9. A copying machine which is provided with a plurality of developing devices performing development using developers of different colors, and forms an image with a plurality of colors by using the different developing devices in one-image forming operation, comprising:

operating means for selecting a position for changing the color to be developed;

detecting means for detecting the state of said operating means;

selecting means for selecting either of a first position or a second position to be determined according to the detected result by said detecting means;

change-over means for changing a plurality of said developing devices; and controlling means for controlling said change-over means so that the developed color is changed at the position selected by said selecting means.

10. A copying machine in accordance with claim 9, wherein said copying machine executes a copying operation by a split mode which splits one original document image into two regions and forms respective images on different copy sheets, respectively; and judging means for detecting which region is copied in, and for controlling the selecting operation of said selecting means according to the detected result.

11. An image forming apparatus which forms an image constituted with a plurality of colors, and can be operated in a plurality of modes, comprising:

image forming means;

region designating means for designating at least one region of an image to be formed;

controlling means which operates said image forming means so as to form an image of at least one region of which is colored differently from other regions based on designating by said region designating means; and mode selecting means for selecting one of a plurality of said modes;

whereby said controlling means changes the region wherein the image is to be formed with a different color from those of other regions based on the selection by said mode selecting means.

12. An image forming apparatus in accordance with claim 11, wherein said modes include a split mode which forms two respective images into which one original image document is split on different copy sheet.

13. An image forming apparatus in accordance with claim 11, wherein said modes include a double-side mode which forms images on the both sides of a copy sheet.

14. A copying machine, comprising:

image forming means for forming an image in a plurality of colors;

operating means for dividing an original image;

selecting means for selecting either a first division or a second division of the original image, said first division and second division depending on the operation of said operating means; and controlling means for controlling said image forming means so as to form an image with a plurality of colors according to said first division or second division.

15. A copying machine which is provided with a plurality of developing devices performing development using developers of different colors, which copies an image with a plurality of colors by changing the different developing devices in one copying operation, and which splits one original document image into a first and a second regions and copies them on a first copy sheet and a second copy sheet, respectively, comprising:

operating means for selecting a position for changing the developed color for said first region;

change-over means for changing a plurality of said developing devices in one image forming operation; and controlling means for controlling said change-over means so that the developed color is changed at the position selected by said operating means in copying said first region on the first copy sheet, and the developed color is also changed in copying said second region on the second copy sheet, wherein the position on the second copy sheet where the developed color is changed is the same as on the first copy sheet.

16. An image forming apparatus which is provided with a plurality of developing devices performing development using developers of different colors, which copies an image with a plurality of colors by changing the different developing devices in one copying operation, and which is capable of operation by a split mode which splits one original document image into a first and a second regions and copies them on different copy sheets respectively, comprising:

operating means for selecting a position for changing the developed color for said first region;

change-over means for changing a plurality of said developing devices in one copying operation; and controlling means for controlling said change-over means so that in operation by said split mode, the developed color is changed at the position selected by said operating means in copying said first region, and the developed color is changed at a position symmetrical with the position selected for said first region of a copy sheet in copying said second region.

17. A copying machine which is provided with a plurality of developing devices performing development using developers of different colors, copies an image with a plurality of colors by changing the different developing devices in one copying operation, and which copies images on the both sides of a copy sheet, comprising:

operating means for selecting a position for changing the developed color for said first region;

change-over means for changing a plurality of said developing devices in one copying operation;

controlling means for controlling said change-over means so that the developed color is changed at the position selected by said operating means in copying on a first side of a copy sheet, and the developed color is changed at the position symmetrical with the position selected for said first region on a copy sheet in copying on a second side of a copy sheet.

18. A copying machine which splits one original document into a first region and a second region and which copies them on different copying papers, comprising:

image forming means which can form an image at least in a first color and a second color;

controlling means for controlling said image forming means so that the image forming color is changed from said first color to said second color in copying operation on said first region, and the image forming color is changed from said second color to said first color in copying operation on said second region.

19. A copying machine which splits one original document into a first region and a second region and which copies them on different copy sheets, comprising:

image forming means which can form an image at least in a first color and a second color;

controlling means for controlling said image forming means so that the image forming color is changed from said first color to said second color in copying operation on said first region, and also in copying operation on said second region.

20. An image forming apparatus which forms an image on the both sides of a copy sheet, comprising:

image forming means which can form an image at least in a first color and a second color; and controlling means for controlling said image forming means so as to start the image forming operation in the first color and changing the image forming color to said second color in forming an image on a first side of the copy sheet, and to start the image forming operation in the second color and changing the image forming color to said first color in forming an image on a second side of the copy sheet.

21. A copying machine which forms a copy image by using a plurality of developing devices with selectively changing said developing devices corresponding to a plurality of regions into which an original document image is divided in a predetermined direction, comprising:

selecting means for selecting a first position for changing the developing device of said original document image;

calculating means which performs predetermined calculations based on a first position for changing the developing device designated by said designating means, and thereby determines a second and a third position for changing the developing device on said original document image;

second selecting means for selecting one position among said first, second and third positions for changing the developing device; and controlling means for controlling a plurality of said developing devices so that the developing device is changed corresponding to the position for changing the developing device selected by said second selecting means.

22. A copying machine which is provided with a plurality of developing devices performing development using developers of different colors, which forms an image with a plurality of colors by changing the different developing devices, and which copies images on the both sides of a copy sheet, comprising;

change-over means for changing the developing device to be used; and controlling means for controlling said change-over means so that the developed color is changed at a first position in copying operation on a first side of a copy sheet, and the developed color is changed at a second position differing from said first position in copying operation on a second side of a copy sheet.

23. An image forming apparatus which forms images on the both sides of a copy sheet, comprising:

a plurality of developing devices performing development using developers of different colors;

change-over means for changing which developing device is in operation; and controlling means for controlling said change-over means so as to operate said plurality of developing devices in a first order upon the image forming operation onto a first side of the copy sheet and operate said plurality of developing devices in a second order different from said first order upon the image forming operation onto a second side of the copy sheet.

24. An image forming apparatus which forms images on the both sides of a copy sheet, comprising:

image forming means for forming images in a plurality of colors; and color control means for sending control signals to the image forming means and controlling colors of the images to be formed, said color control means changing a content of the control of the colors between the image formation onto a first side of the copy sheet and the image formation onto a second side of the copy sheet.

25. An image forming apparatus in accordance with claim 24, wherein said color control means selects the color of the image, and said image forming means comprises a first means for forming images in a first color on the copy sheet and second means for forming images in a second color on the copy sheet and selectively operates the first and second means according to the selection by said color control means.

26. An image forming apparatus in accordance with claim 25, wherein said image forming means changes the color of the image in response to the control signals, and said color control means changes a timing of sending the control signal between the image formation onto a first side of the copy sheet and the image formation onto a second side of the copy sheet.

27. An image forming apparatus in accordance with claim 24, further comprising designating means for designating a specific portion of the image to be formed, wherein said color control means controls the colors of the images so that an image corresponding to the specific portion is formed in a first color and an image corresponding to the other portion is formed in a second color.

28. An image forming apparatus which forms images on the both sides of a copy sheet, comprising:

image forming means for forming images on the copy sheet;

sheet refeeding means for refeeding the copy sheet to said image forming means for an image formation on a second side of the copy sheet after an image formation on a first side of the copy sheet;

designating means manually operable for designating a specific portion of the images to be formed; and controlling means for controlling said image forming means according to the designation by said designating means;

wherein said controlling means changes a content of the control of the image forming means between the image formation onto a first side of the copy sheet and the image formation onto a second side of the copy sheet.

29. A copying machine which splits an original image into at least a first region and a second region and which copies them on different copying sheets, comprising:

image forming means for forming an image in a plurality of colors; and controlling means for controlling said image forming means between an image formations of said first and second regions to change the colors to be used.

30. A copying machine which splits an original image into at least a first region and a second region and which copies them on different copying sheets, comprising:

a plurality of developing devices;

driving means for selectively driving said plurality of developing devices for image formation; and controlling means for controlling said driving means between an copying operation of said first region and a copying operation of said second region to change the developing device to be driven.

31. An image forming apparatus which forms images on the both sides of a copy sheet, comprising:

image forming means for forming images in a plurality of colors;

selecting means for selecting one of first and second copying modes; and color control means for sending control signals to the image forming means and controlling colors of the images to be formed;

wherein said color control means changes a content of the control of the colors between the image formation onto a first side of the copy sheet and the image formation onto a second side of the copy sheet when the first copying mode is selected, and equally controls on the image formations onto the first and second sides when the second copying mode is selected.

32. A copying machine which splits an original image into at least a first region and a second region and which copies them on different copying sheets, comprising:

a plurality of developing devices;

driving means for selectively driving said plurality of developing devices for image formation;

selecting means for selecting one of first and second copying modes; and controlling means for, when the first mode is selected by said selecting means, controlling said driving means between an copying operation of said first region and a copying operation of said second region to change the developing device to be driven.

* * * * *